United States Patent [19]

Nakamura

[11] Patent Number: 4,668,611

[45] Date of Patent: May 26, 1987

[54] COLOR PHOTOGRAPHIC LIGHT-SENSITIVE MATERIAL

[75] Inventor: Kotaro Nakamura, Kanagawa, Japan

[73] Assignee: Fuji Photo Film Co., Ltd., Kanagawa, Japan

[21] Appl. No.: 915,872

[22] Filed: Oct. 8, 1986

Related U.S. Application Data

[63] Continuation of Ser. No. 585,690, Mar. 2, 1984, abandoned.

[30] Foreign Application Priority Data

Mar. 2, 1983 [JP] Japan ..... 58-35178

[51] Int. Cl.[4] ..... G03C 1/46; G03C 1/10; G03C 1/84; G03C 7/32

[52] U.S. Cl. ..... 430/507; 430/505; 430/512; 430/546; 430/551; 430/553; 430/557; 430/558

[58] Field of Search ..... 430/505, 507, 512, 546, 430/553, 557, 558, 551

[56] References Cited

U.S. PATENT DOCUMENTS

| | | | |
|---|---|---|---|
| 2,172,262 | 9/1939 | Schinzel | 430/512 X |
| 3,243,294 | 3/1966 | Barr | 430/505 X |
| 3,434,837 | 3/1969 | Knott et al. | 430/512 X |
| 3,687,671 | 8/1972 | Kreuder et al. | 430/512 |
| 3,930,863 | 1/1976 | Shiba et al. | 430/505 |
| 4,208,210 | 6/1980 | Sakai et al. | 430/512 X |
| 4,326,022 | 4/1982 | Ito et al. | 430/546 |
| 4,370,410 | 1/1983 | Iijima et al. | 430/505 |
| 4,374,919 | 2/1983 | Toriuchi | 430/512 X |
| 4,409,324 | 10/1983 | Ishikawa et al. | 430/546 |
| 4,456,681 | 6/1984 | Kadowaki et al. | 430/507 X |

*Primary Examiner*—John E. Kittle
*Assistant Examiner*—Mukund J. Shan
*Attorney, Agent, or Firm*—Sughrue, Mion, Zinn, Macpeak & Seas

[57] ABSTRACT

A color photographic light-sensitive material comprising a support having thereon, in sequence:

(1) a blue-sensitive silver halide emulsion layer containing, dispersed in the emulsion using a high-boiling organic solvent, a yellow coupler represented by the following general formula (I):

(I)

with the weight ratio of the high-boiling organic solvent for dispensing the coupler to the yellow coupler being 1.0:1 or less;

(2) a green-sensitive silver halide emulsion layer containing a magenta coupler represented by the following general formula (II):

(II)

(3) a red-sensitive silver halide emulsion layer containing a cyan coupler represented by the following general formula (III):

(III)

(4) an ultraviolet light absorbing layer containing an ultraviolet light absorbent represented by the following general formula (IV):

(IV)

in which the substituents X, Z, and $R_1$–$R_{12}$ are as defined in the specification. The color photographic light-sensitive material provides a dye image which is resistant to fading or discoloration by light, and in particular provides color prints having a well-balanced fading of the dye image composed of the three yellow, magenta and cyan colors.

16 Claims, No Drawings

COLOR PHOTOGRAPHIC LIGHT-SENSITIVE MATERIAL

This is a continuation of application Ser. No. 585,690 filed Mar. 2. 1984, now abandoned.

FIELD OF THE INVENTION

This invention relates to a silver halide color photographic light-sensitive material which provides, after development processing, a dye image resistant to fading or discoloration by light.

BACKGROUND OF THE INVENTION

Dye images obtained by development processing of silver halide color photographic light-sensitive materials generally comprise azomethine dyes or indoaniline dyes formed by the reaction between an oxidation product of an aromatic primary amine developing agent and couplers. The thus-obtained dye images are not fully stable to light and, when exposed to light for a long period of time, fading or discoloration of dye image portions usually results, leading to deterioration in image quality. This defect is a critical problem with, particularly, color print materials which, after development processing, themselves are displayed to appreciate or are stored as records.

Various improvements have been proposed for removing the defect, some of which have been actually put into commercial practice.

For example, with yellow dye images, fading and discoloration caused by light can be decreased to some extent by changing benzoylacetanilide type yellow couplers to pivaloylacetanilide type yellow couplers, as is described in U.S. Pat. No. 3,265,506 and T. H. James, *The Theory of the Photographic Process,* 4th Ed., p. 354 (1979, Macmillan Co.). However, this technique still does not improve the stability to light to a satisfactory level.

With magenta dye images, changes in the chemical structure of the coupler are believed to cause less influence on the stability to light (see, for example, W. G. Herkstroeter, *Mol. Photochem.,* 3, 181 (1971), W.F. Smith, Jr., et al, *J. Am. Chem. Soc.,* 97, 2764 (1975), etc.). Accordingly, only agents for preventing fading by light have been used for stabilizing magenta dye images to light. Many compounds have been proposed such as hydroxychromans described in U.S. Pat. No. 3,432,300, phenolic hydroxy group-containing compounds described in U.S. Pat. No. 3,698,909, alkyl ethers described in Japanese Patent Application (OPI) No. 77526/78 (the term "OPI" as used herein refers to a "published unexamined Japanese patent application"), and metal complexes described in U.S. Pat. Nos. 4,248,949 and 4,241,155. However, although these compounds show an effect of preventing, to some extent, fading or discoloration of the dye image by light, the effect is not satisfactory, and often concurrently detrimental influences such as deterioration of hue, fogging, insufficient dispersion, crystallization, etc., are exerted thus not having been used in sufficient amounts to fully prevent fading or discoloration by light.

In comparison with the yellow and magenta dye images, cyan dye images generally have a considerably high stability to light. Accordingly, improvement of the stability of cyan dye images has been mainly directed to stability to heat or humidity. However, as a result of tracing the decomposition reaction of cyan dye images to light, the existence of a leuco form cyan dye in the course of the decomposition reaction is suggested. In addition, it has been found that this leuco form cyan dye is produced in an extremely short time when exposed to light, that reduction in density of cyan dye image due to this reaction is faster than that of the yellow and magenta dye images, that, when exposure to light is continued, the leuco form cyan dye gradually returns to the original cyan dye, and that the cyan dye repeatedly undergoes this phenomenon with a gradual reduction in density occurring. Therefore, in order to attain higher stability to light, it is necessary to newly establish a technique for preventing fading or discoloration of cyan dye images by light.

In addition to the above-described improvement techniques, Japanese Patent Application (OPI) Nos. 11330/74 and 57223/75 describe a technique of surrounding dye images by an oxygen barrier layer composed of a substance with a low oxygen permeability, and Japanese Patent Application (OPI) No. 85747/81 describes a technique of providing on the support side of dye-forming layers of a color photographic light-sensitive material a layer having an oxygen permeability of 20 $ml/m^2.hr.atom$ or less. These techniques are truely effective for preventing yellow and magenta dye images from fading or discoloration but, with respect to cyan dye image, they are absolutely ineffective or rather accelerate fading or discoloration. Thus, this is inconsistent with the objects of the present invention.

As is described above, conventional techniques for stabilizing respective dye images to light are still insufficient with respect to their ability to "store and utilize color photographic images as records for a long period of time without any change", which is in particular a requirement for color print materials. In addition, since the difference in stability to light between yellow, magenta, and cyan dye images of a color print material has not been well considered in the prior art, color print materials have tended to undergo a deterioration of color balance when exposed to light for a long time; for example, images formed on some color print materials acquire a blue tint, and others acquire a red tint.

Accordingly, to prevent discoloration or fading of color print materials by light, it is absolutely necessary to maintain the color balance between the three yellow, magenta and cyan colors even when fading of dye images takes place as well as to attain maximum stabilization of each dye image to light. Further, with respect to this, care must be taken that heat or humidity does not accelerate the discoloration or fading of dye images by light.

SUMMARY OF THE INVENTION

An object of the present invention is to provide a color photographic light-sensitive material which provides, after development processing, a dye image which undergoes less discoloration or fading due to light.

Another object of the present invention is to provide a color photographic light-sensitive material which, when exposed to light, undergoes well balanced fading of dye image composed of the three yellow, magenta and cyan colors.

A further object of the present invention is to provide a color photographic light-sensitive material which contains couplers with good hue and good color-forming efficiency and which, after photographic processing, undergoes less discoloration or fading of formed dye images.

A still further object of the present invention is to provide a color photographic light-sensitive material which undergoes less discoloration or fading of dye images by humidity or heat as well as by light.

To attain these objects, magenta dye images which undergo the most discoloration or fading by light were first studied. As a result, it was found that a relationship exists between the low color-forming efficiency of magenta couplers and the poor stability to light of magenta dye images. That is, upon reaction with an oxidation product of a developing agent, only about 40 to 50% of the magenta couplers are generally converted to dyes, with the rest producing compounds of unknown structures. This reaction is clearly different from those of yellow couplers and cyan couplers. In view of this finding, the use of 2-equivalent type 5-pyrazolone couplers which have a good color-forming efficiency has been found to be effective for improving stability of magenta dye images to light.

Stabilization of magenta dye images to light can be almost fully attained by the above-described technique. However, in order to maintain the color balance of the three yellow, magenta and cyan colors, which is one object of the present invention, stability of yellow dye images and cyan dye images to light must be improved for the three color images to possess about the same stability to light.

Accordingly, yellow dye images were studied and, as a result, it was found that the stability to light of dye obtained from a pivaloylacetanilide type yellow coupler is specifically improved when the amount of solvent for dispersing the dye (high-boiling organic solvent=oil) is within a definite range, i.e., when the weight ratio of the high-boiling solvent to the pivaloylacetanilide type yellow coupler is not more than 1.0:1, particularly 0.8:1 to 0.1:1, with the stability to light concurrently being well balanced with that of the above-described magenta dye images.

Stability of yellow dye images and magenta dye images to light can be greatly improved by the above-described techniques of the present invention. Therefore, stability of cyan dye images which have conventionally been considered stable to light must now be improved to the same degree as that of yellow and magenta colors. As a result of various investigations for stabilizing cyan dye images to light, it was concluded the most effective means is to protect cyan dye images from ultraviolet light as much as possible. In embodying this technique in a color photographic light-sensitive material, a layer containing an ultraviolet light absorbent, which has conventionally been provided between a green-sensitive silver halide emulsion layer and a red-sensitive silver halide emulsion layer is now provided on or above the red-sensitive silver halide emulsion layer.

The present invention involves use of the combination of the above-described techniques, and provides a color photographic light-sensitive material comprising a support having thereon in sequence:

(1) a blue-sensitive silver halide emulsion layer containing a yellow coupler represented by the following general formula (I), with the weight ratio of a high-boiling solvent for dispersing the coupler to the yellow coupler being 1.0:1 or less;

(2) a green-sensitive silver halide emulsion layer containing a magenta coupler represented by the following general formula (II);

(3) a red-sensitive silver halide emulsion layer containing a cyan coupler represented by the following general formula (III); and (4) an ultraviolet light-absorbing layer containing an ultraviolet light absorbent represented by the following general formula (IV).

DETAILED DESCRIPTION OF THE INVENTION

The yellow coupler or couplers can be one or more compounds selected from the compounds represented by the following general formula (I):

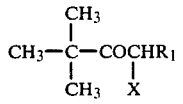

(I)

wherein $R_1$ represents an N-phenylcarbamoyl group which may optionally have a substituent or substituents, and X represents a coupling-off group.

Suitable substituents for the N-phenylcarbamoyl group represented by $R_1$ include those substituents which are well known with respect to yellow couplers, such as an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxy group, a sulfo group, a nitro group, a cyano group, a thiocyano group, etc. Two or more of such substituents may exist, and the two or more substituents can be the same or different.

The coupling-off group, X, may be a hydrogen atom, but preferably represents a coupling-off group forming a 2-equivalent yellow coupler, such as a group represented by the following general formula (X), (XI), (XII) or (XIII):

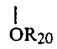

(X)

wherein $R_{20}$ represents an optionally substituted aryl or heterocyclic group;

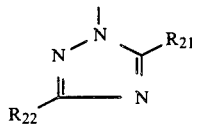

(XI)

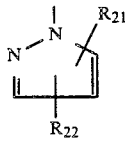

(XII)

wherein $R_{21}$ and $R_{22}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or an unsubstituted or substituted phenyl or heterocyclic gruop, which may be the same or different;

(XIII)

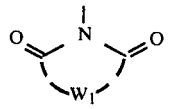

wherein $W_1$ represents the non-metallic atoms necessary for forming a 4-, 5- or 6-membered ring together with

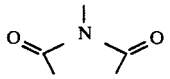

in the formula.

Of the substituents represented by the general formula (XIII), preferable substituents are those represented by the formulas (XIV) to (XVI):

(XIV)

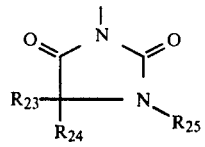

(XV)

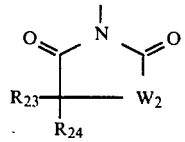

(XVI)

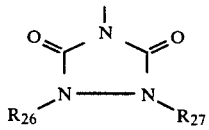

wherein $R_{23}$ and $R_{24}$ each represents a hydrogen atom, an alkyl group, an aryl group, an alkoxy group, an aryloxy group or a hydroxy group, $R_{25}$, $R_{26}$, and $R_{27}$ each represents a hydrogen atom, an alkyl group, an aryl group, an aralkyl group or an acyl group, and $W_2$ represents an oxygen atom or a sulfur atom.

Specific examples of yellow couplers which can be used are as follows.

(Y-1)

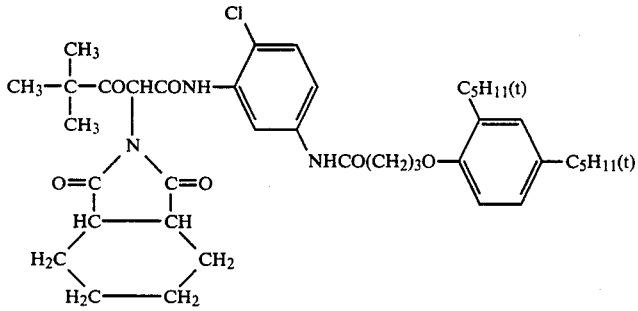

(Y-2)

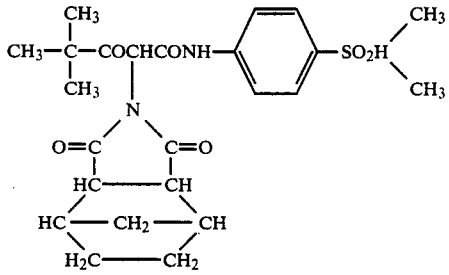

(Y-3)

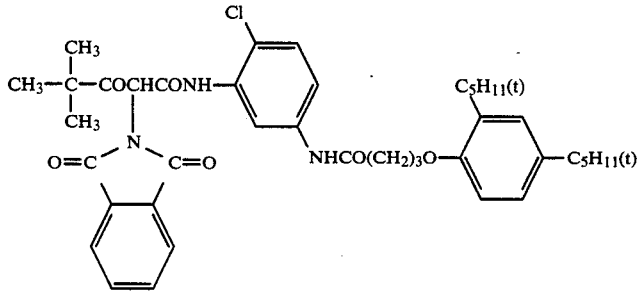

-continued
(Y-4)
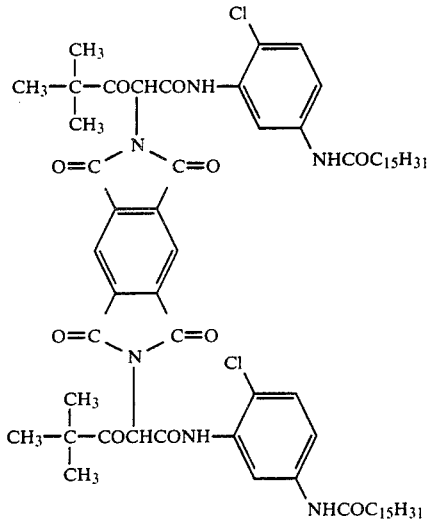
(Y-5)
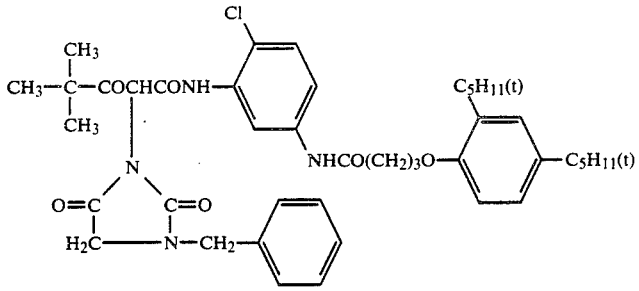
(Y-6)
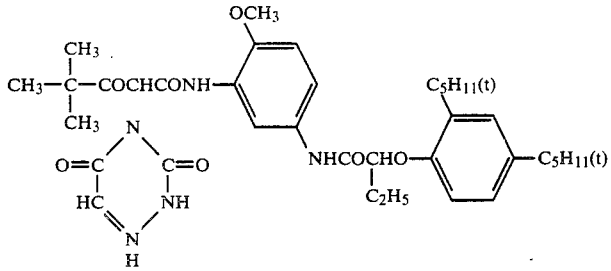
(Y-7)
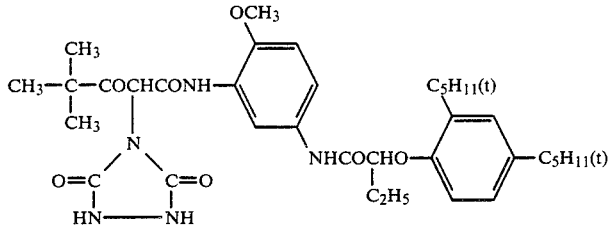
(Y-8)
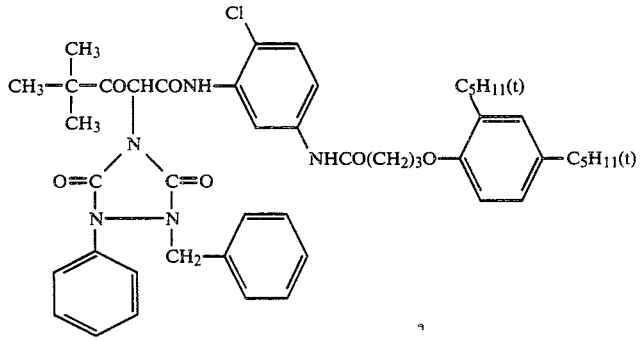

-continued
(Y-9)
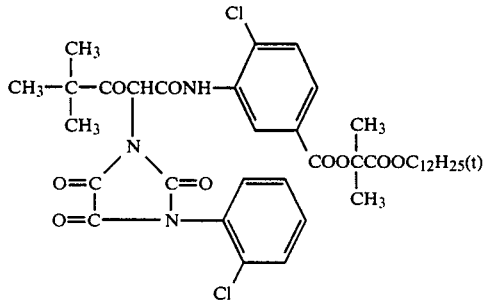
(Y-10)
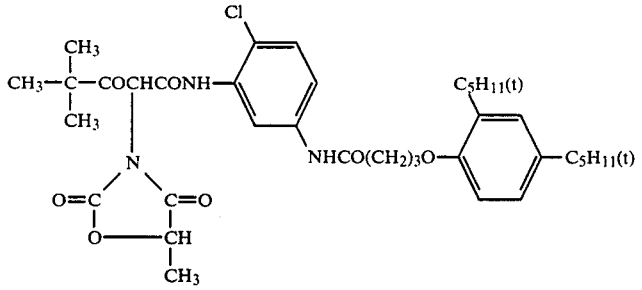
(Y-11)
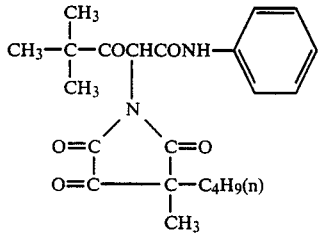
(Y-12)
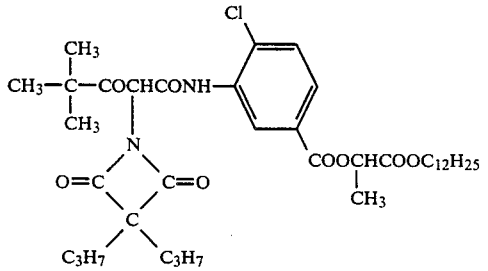
(Y-13)
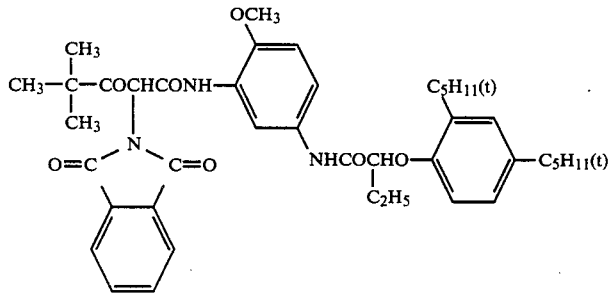

-continued
(Y-14)
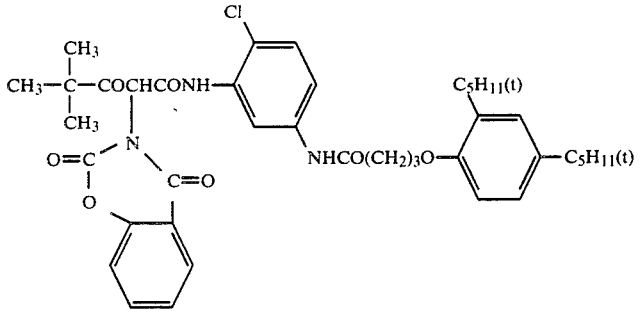
(Y-15)
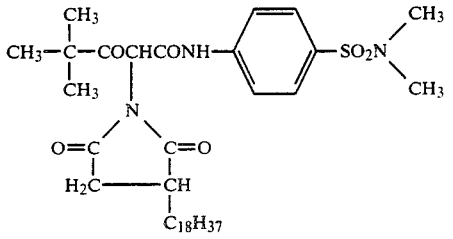
(Y-16)
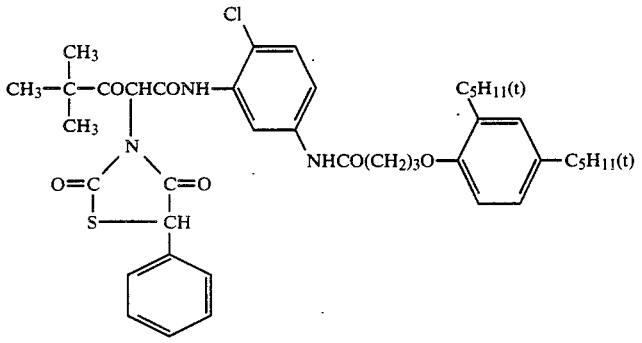
(Y-17)
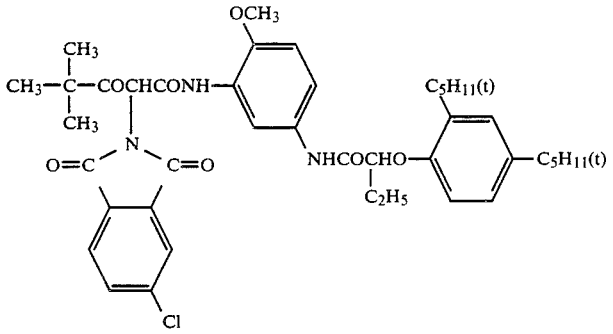
(Y-18)
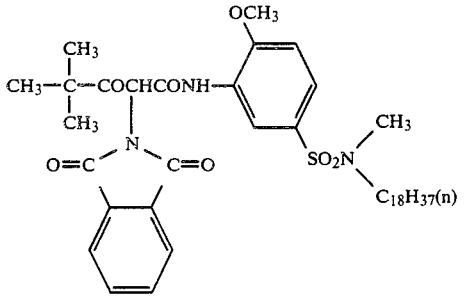

-continued
(Y-19)
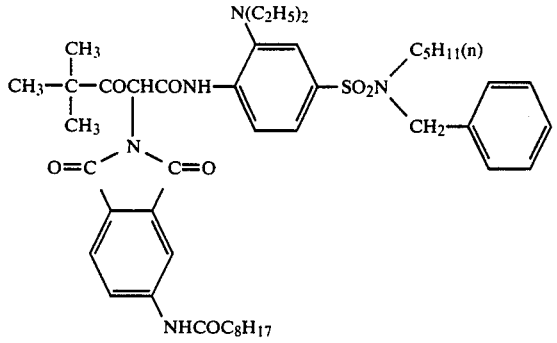
(Y-20)
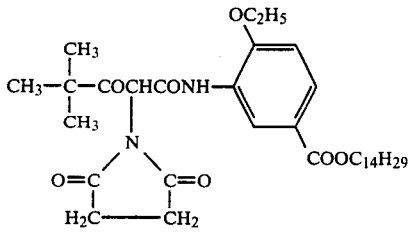
(Y-21)
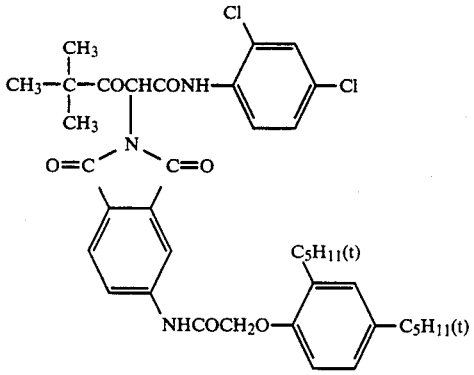
(Y-22)
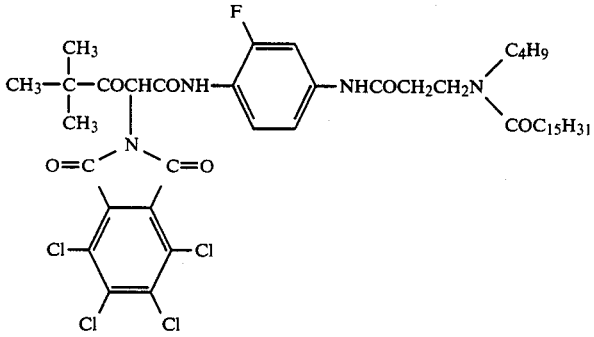
(Y-23)
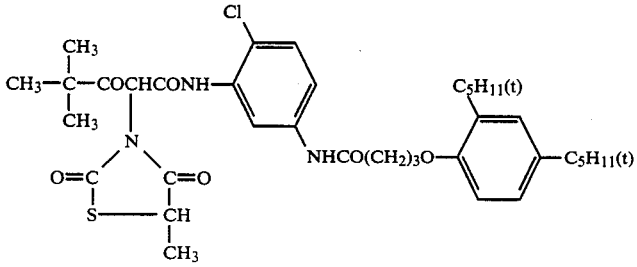

-continued
(Y-24)
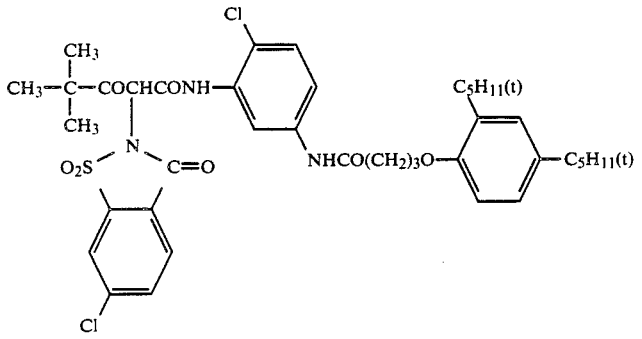
(Y-25)
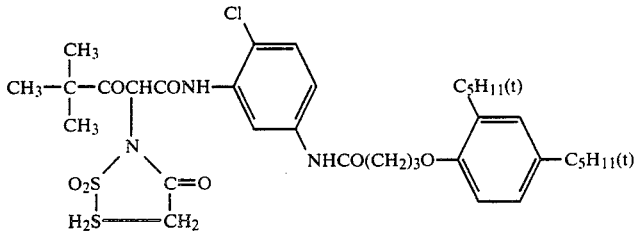
(Y-26)
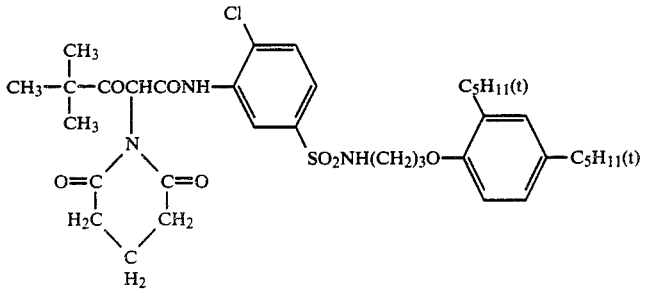
(Y-27)
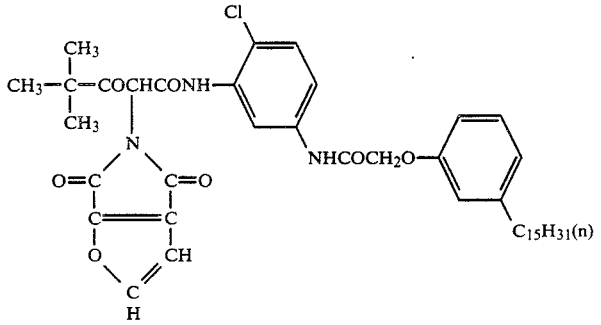
(Y-28)
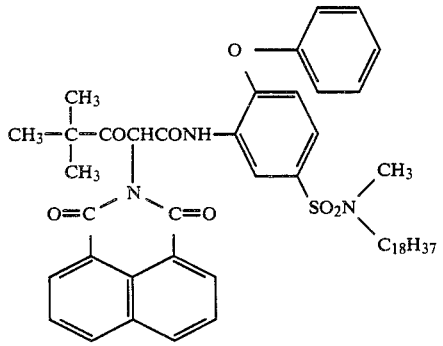

-continued
(Y-29)
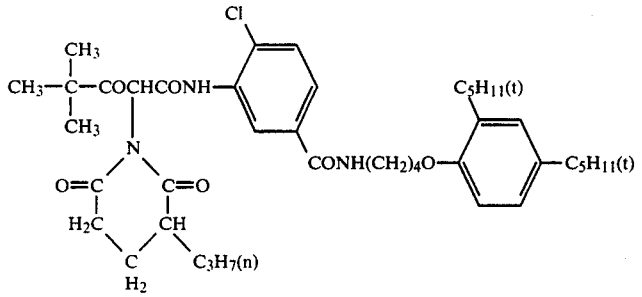
(Y-30)
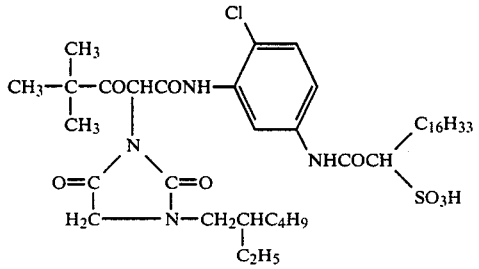
(Y-31)
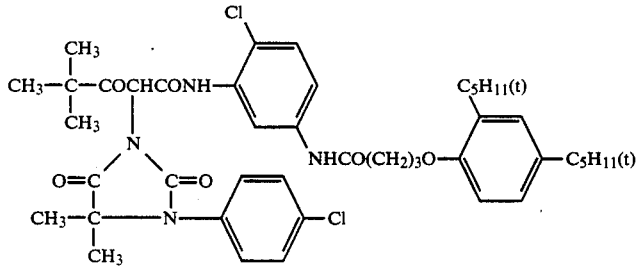
(Y-32)
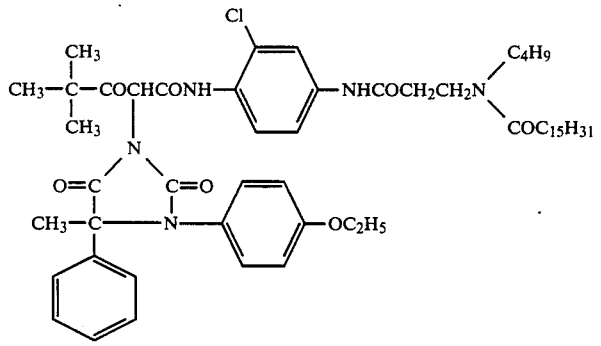
(Y-33)
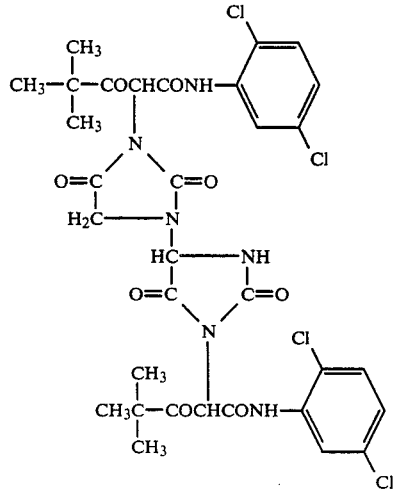

-continued
(Y-34)
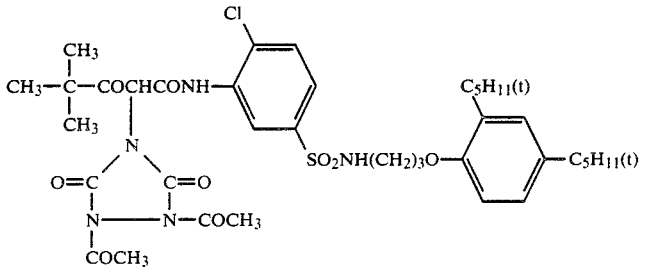
(Y-35)
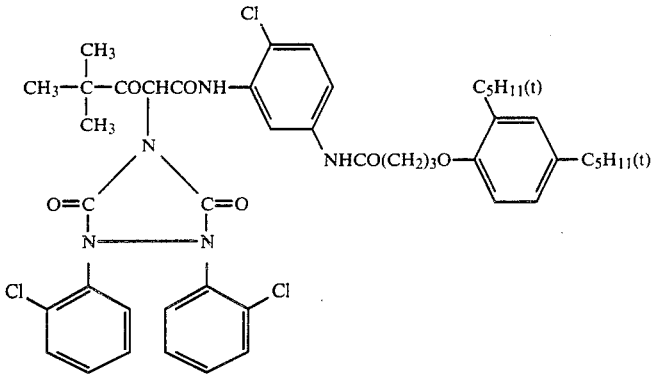
(Y-36)
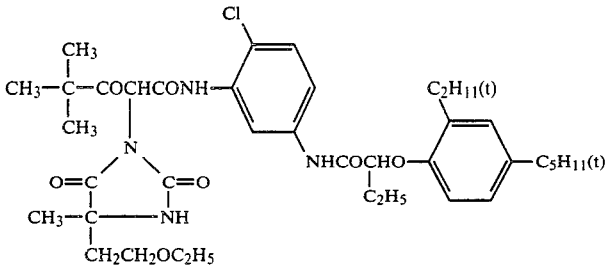
(Y-37)
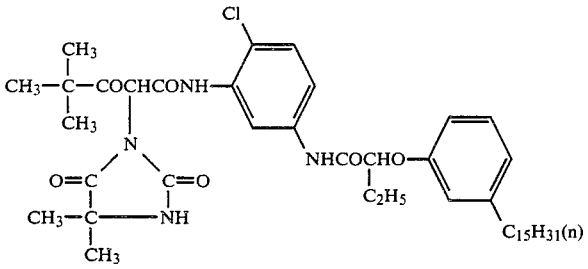
(Y-38)
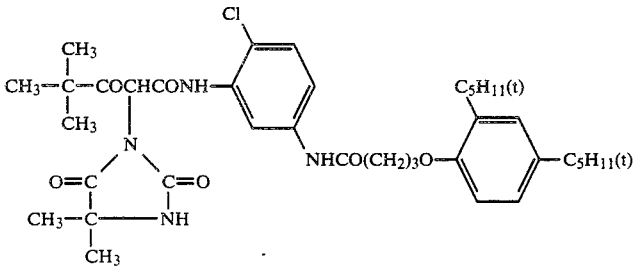

-continued
(Y-39)
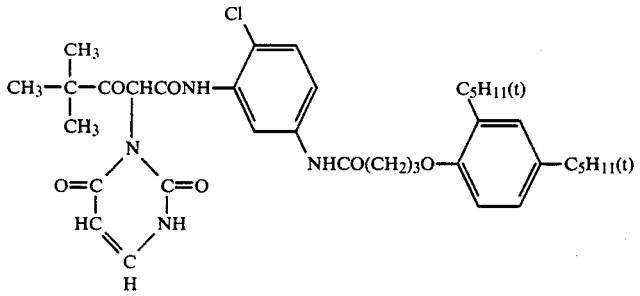
(Y-40)
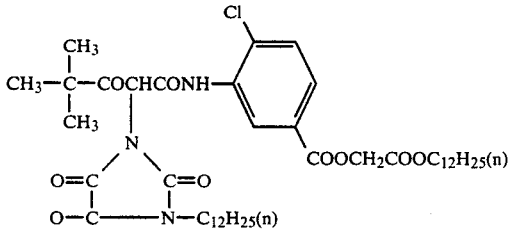
(Y-41)
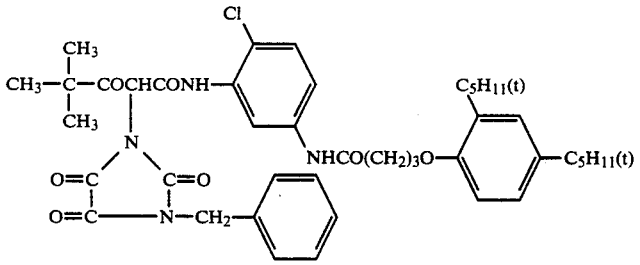
(Y-42)
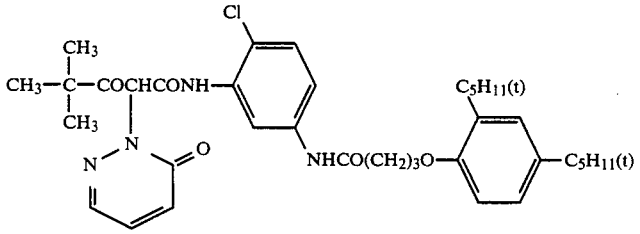
(Y-43)
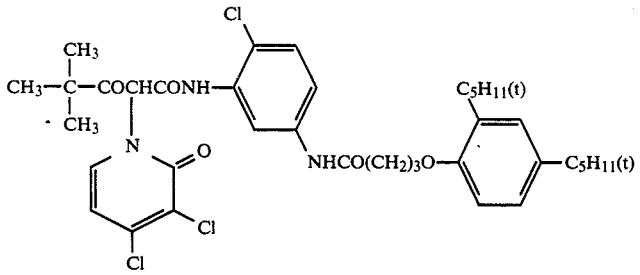
(Y-44)
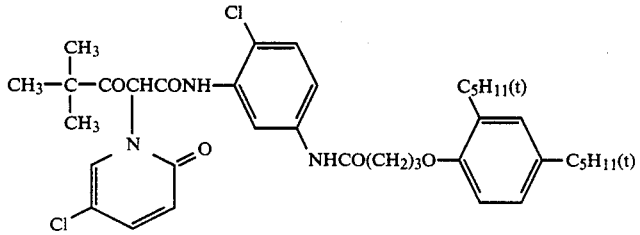

-continued
(Y-45)
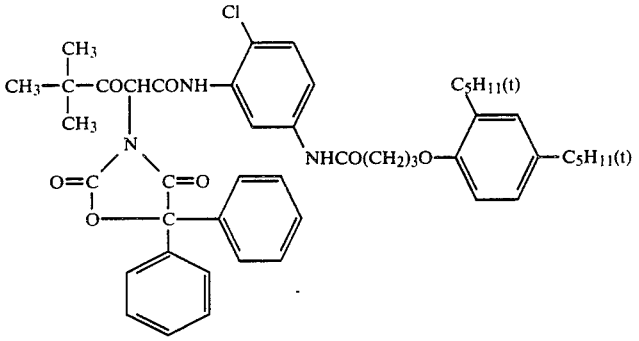
(Y-46)
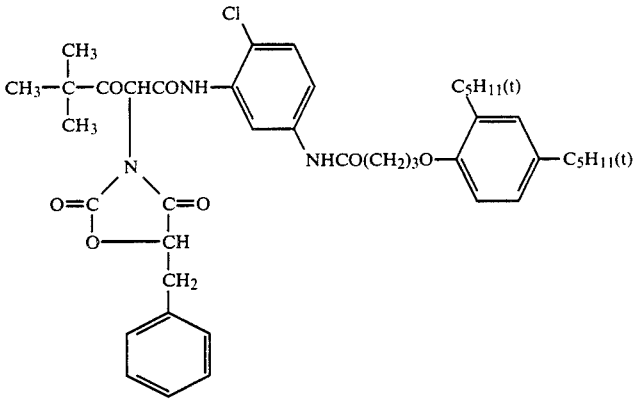
(Y-47)
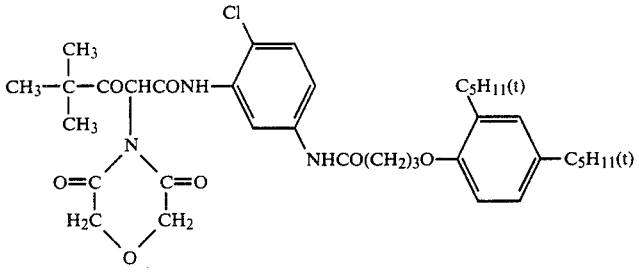
(Y-48 )
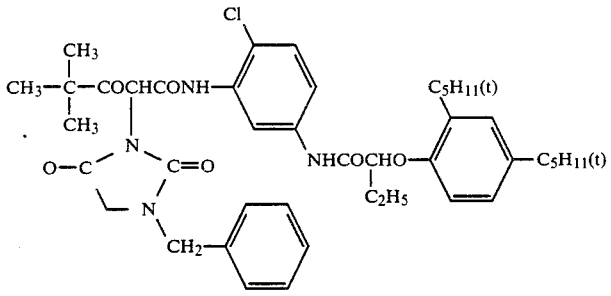
(Y-49)
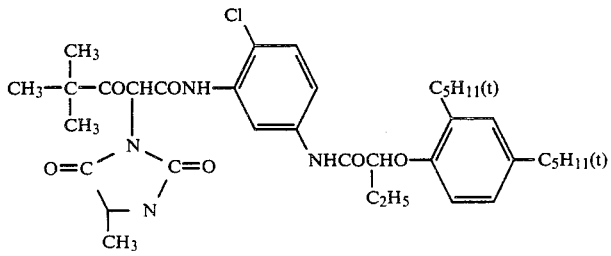

-continued (Y-50)

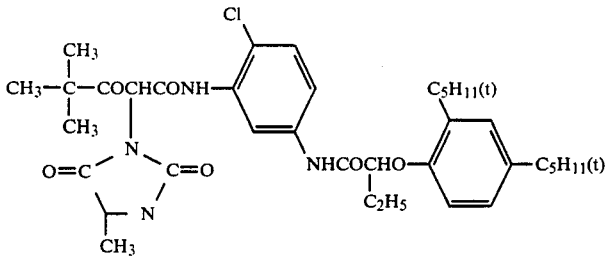

(Y-51)

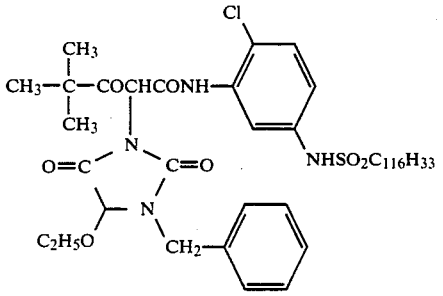

(Y-52)

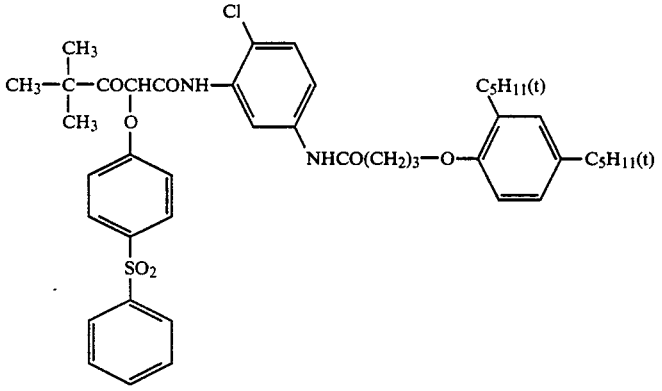

Suitable magenta coupler or couplers which can be used in the present invention are one or more compounds selected from those represented by the following general formula (II):

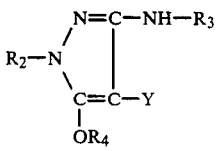

(II)

wherein $R_2$ and $R_3$ each represents an optionally substituted phenyl group, $R_4$ represents a sulfonyl group, an acyl group or a hydrogen atom, and Y represents a coupling-off group capable of forming a 2-equivalent magenta coupler.

Suitable substituents for the phenyl group represented by $R_2$ and $R_3$ are those substituents which are well known with respect to magenta couplers, such as an alkyl group (e.g., a methyl group, an ethyl group, etc.), an alkoxy group (e.g., a methoxy group, an ethoxy group, etc.), an aryloxy group (e.g., a phenyloxy group, etc.), an alkoxycarbonyl group (e.g., a methoxycarbonyl group, etc.), an acylamino group (e.g., an acetylamino group, etc.), a carbamoyl group, an alkylcarbamoyl group (e.g., a methylcarbamoyl group, an ethylcarbamoyl group, etc.), a dialkylcarbamoyl group (e.g., a dimethylcarbamoyl group, etc.), an arylcarbamoyl group (e.g., a phenylcarbamoyl group, etc.), an alkylsulfonyl group (e.g., a methylsulfonyl group, etc.), an arylsulfonyl group (e.g., a phenylsulfonyl group, etc.), an alkylsulfonamido group (e.g., a methanesulfonamido group, etc.), an arylsulfonamido group (e.g., a phenylsulfonamido group, etc.), a sulfamoyl group, an alkylsulfamoyl group (e.g., an ethylsulfamoyl group, etc.), a dialkylsulfamoyl group (e.g., a dimethylsulfamoyl group, etc.), an alkylthio group (e.g., a methylthio group, etc.), an arylthio group (e.g., a phenylthio group, etc.), a cyano group, a nitro group, and a halogen atom (e.g., a fluorine atom, a chlorine atom, a bromine atom, etc.). Where two or more substituents are present, they may be the same or different.

Particularly preferred substituents include a halogen atom, an alkyl group, an alkoxy group, an alkoxycarbonyl group, a cyano group, etc.

Y represents a coupling-off group bonded to the coupling position via an oxygen atom, a nitrogen atom or a sulfur atom. Where Y is bonded to the coupling position via an oxygen atom, a nitrogen atom or a sulfur atom, these atoms are bonded to an alkyl group, an aryl group, an alkylsulfonyl group, an arylsulfonyl group, an alkylcarbonyl group, an arylcarbonyl group or a heterocyclic group (wherein the alkyl, aryl or heterocyclic group may possess a group or groups referred to as substituents for the above-described phenyl group represented by $R_2$) and, where Y is bonded to the coupling position via a nitrogen atom, Y may represent a coupling-off group forming a 5- or 6-membered ring together with the nitrogen atom (for example, an imidazolyl group, a pyrazolyl group, a triazolyl group, a tetrazolyl group, or the like).

The sulfonyl or acyl group represented by $R_4$ preferably contains a lower alkyl group which may optionally be substituted by a halogen atom or the like.

Typical examples of magenta couplers are illustrated below:

(M-1)

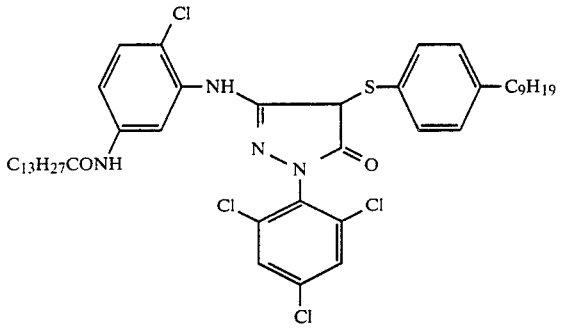

(M-2)

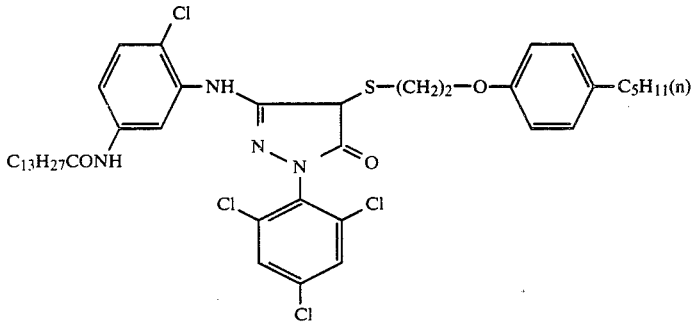

(M-3)

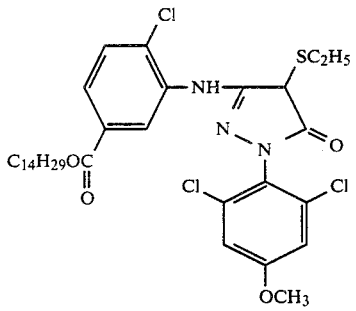

(M-4)

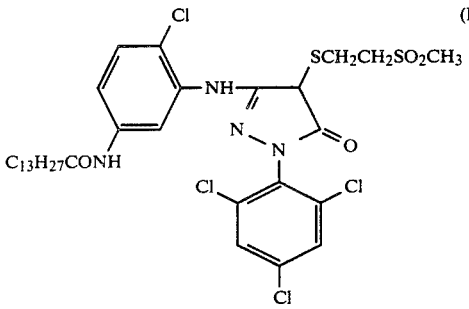

(M-5)

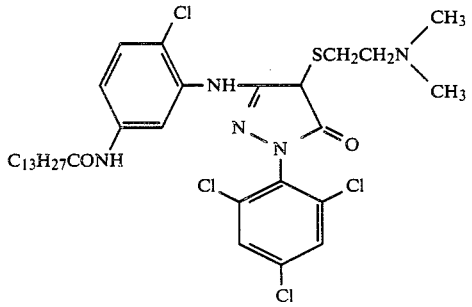

-continued
(M-6)
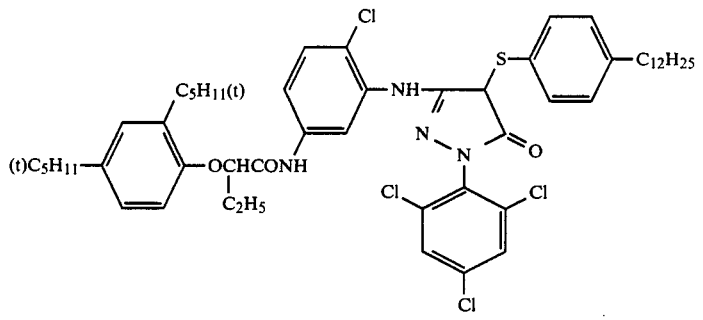
(M-7)
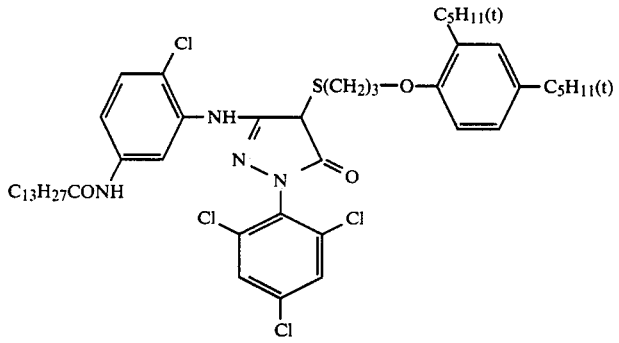
(M-8)
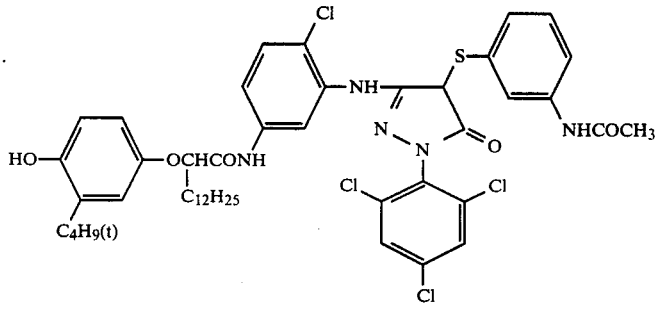
(M-9)
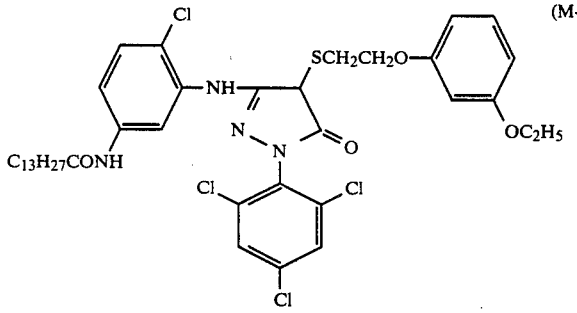
(M-10)
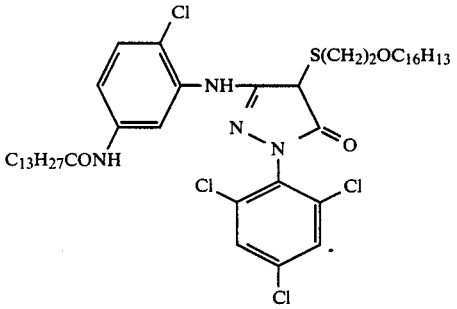
(M-11)
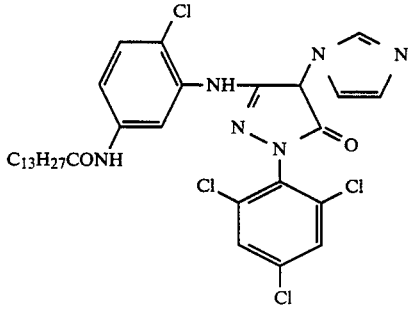
(M-12)
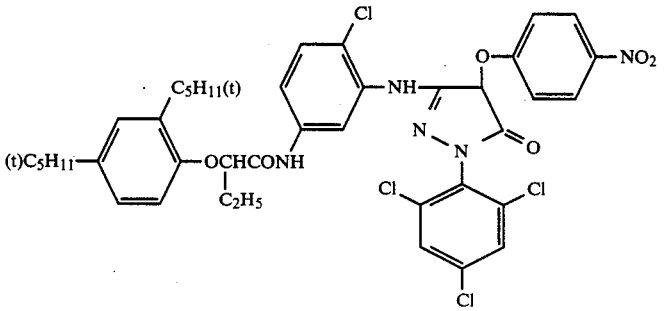

-continued
(M-13)
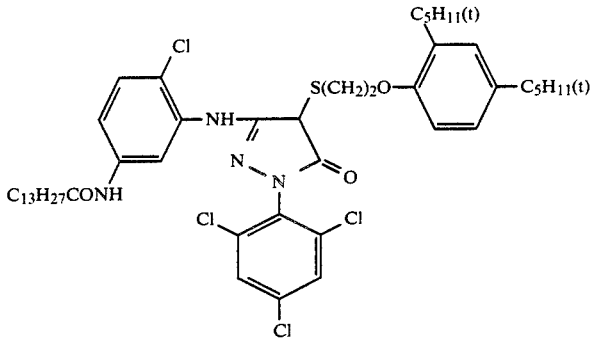
(M-14)
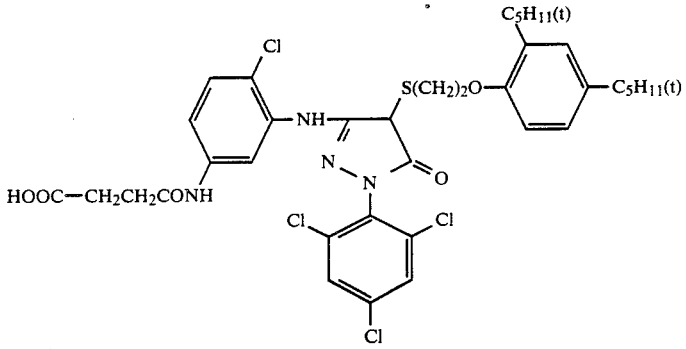
(M-15)
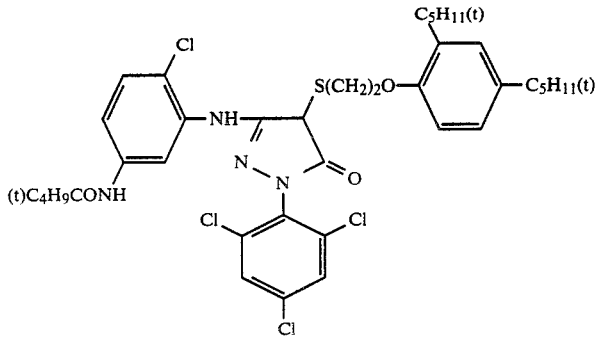
(M-16)
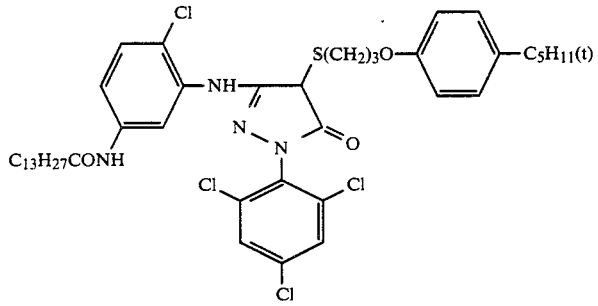
(M-17)
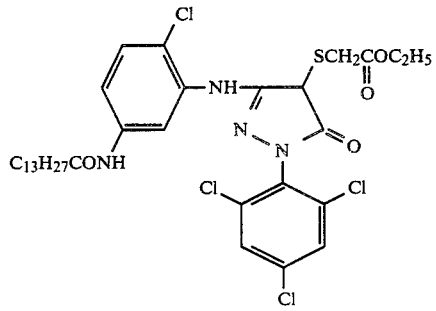
(M-18)
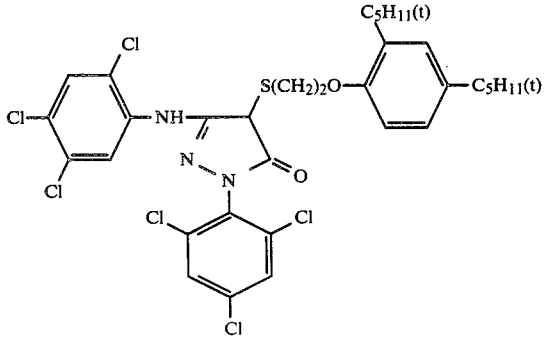

-continued
(M-19)
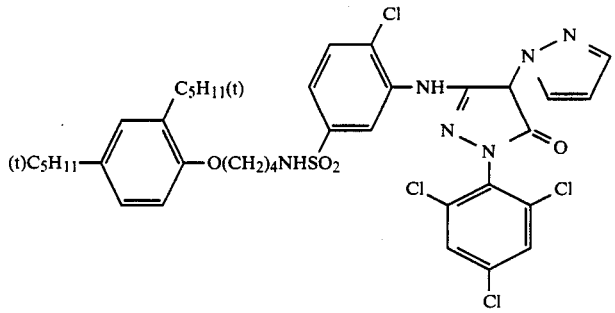
(M-20)
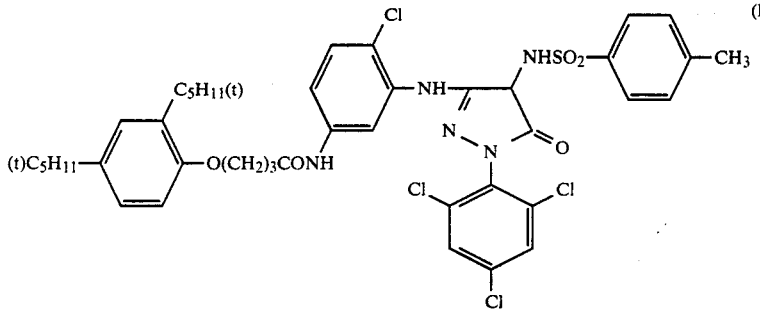
(M-21)
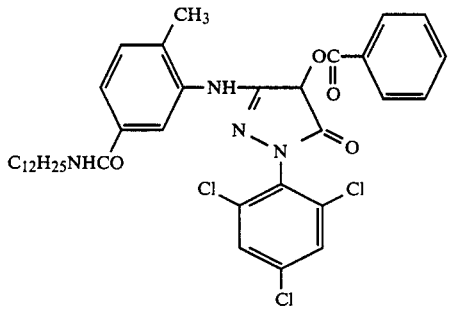
(M-22)
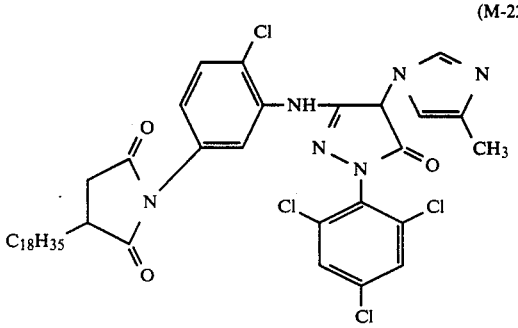
(M-23)
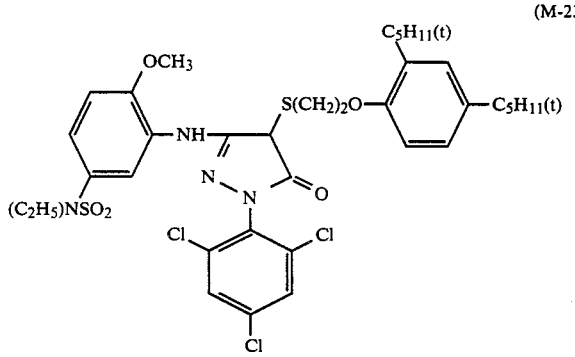
(M-24)
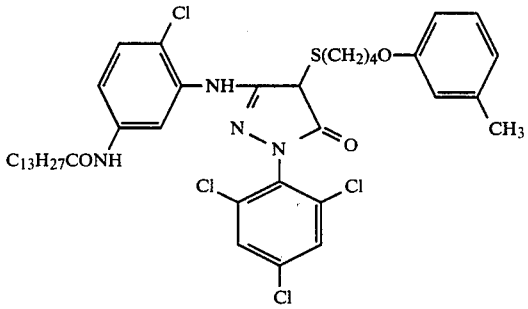
(M-25)
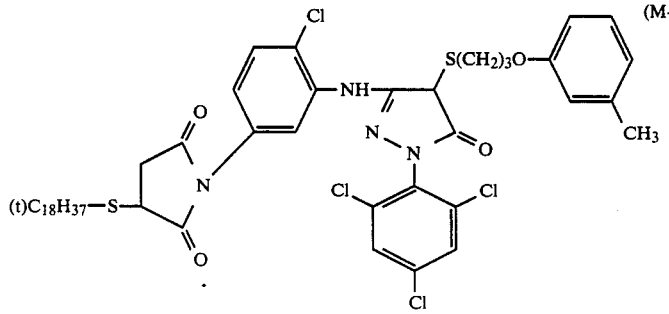

-continued
(M-26)
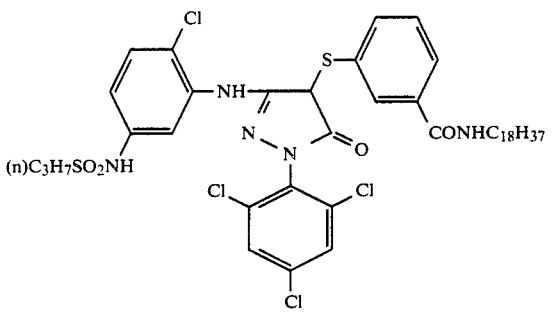
(M-27)
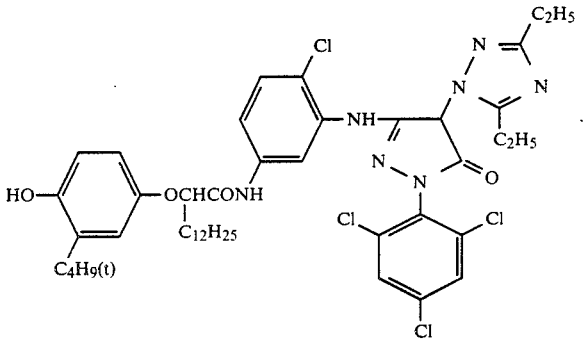
(M-28)
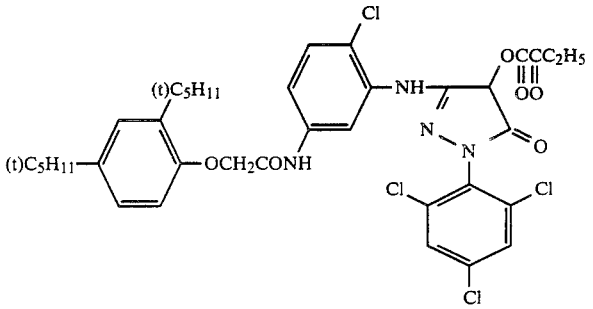
(M-29)
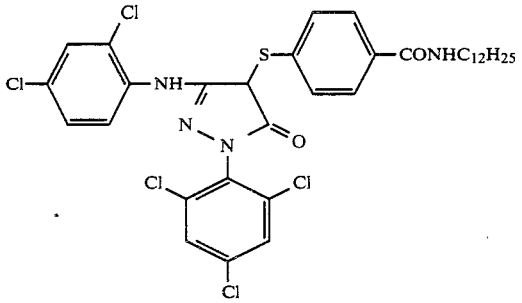
(M-30)
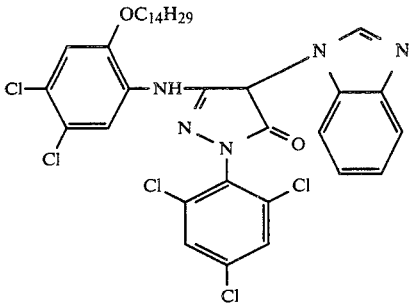
M(-31)
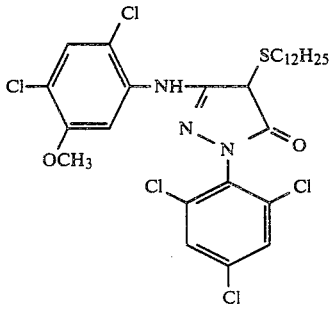
(M-32)
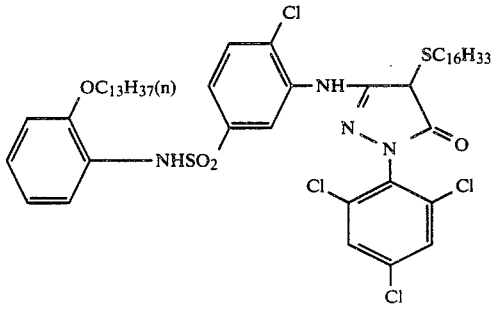

-continued
(M-33)
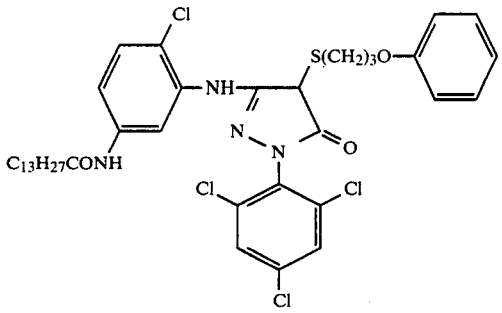
(M-34)
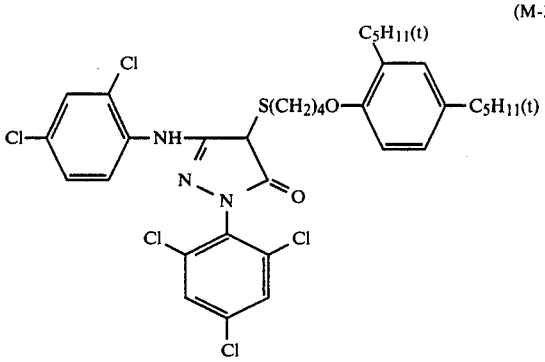
(M-35)
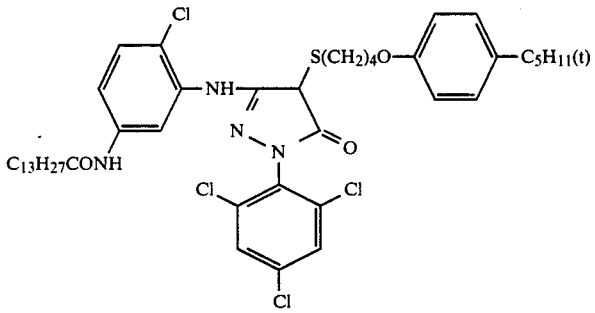
(M-36)
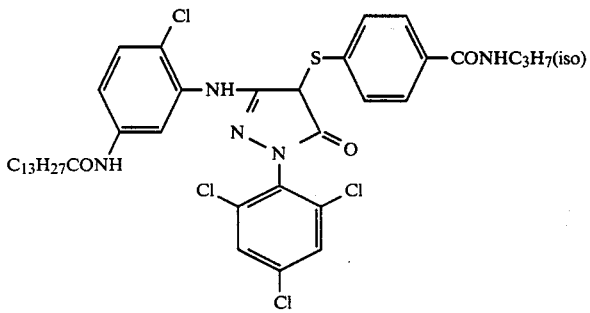
(M-37)
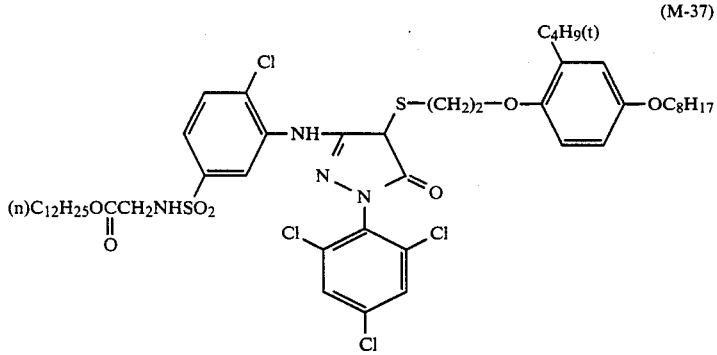
(M-38)
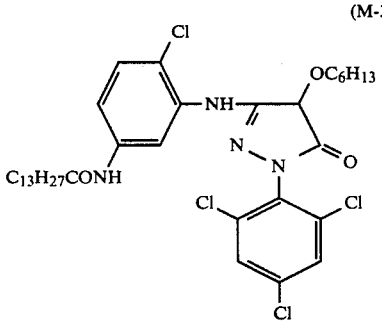
(M-39)
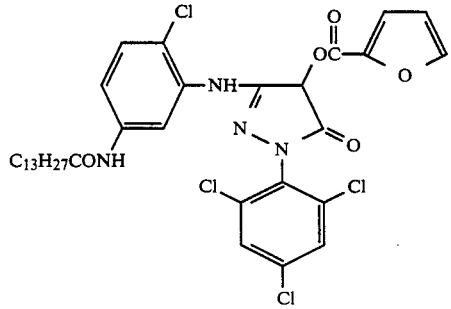
(M-40)
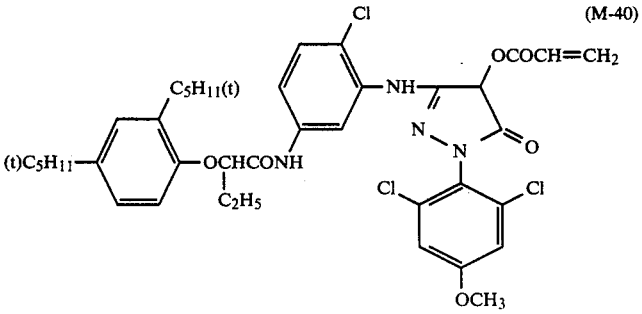

-continued
(M-41)
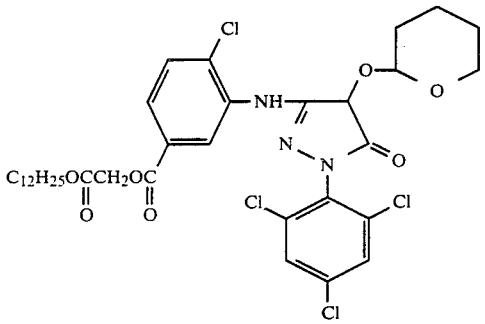
(M-42)
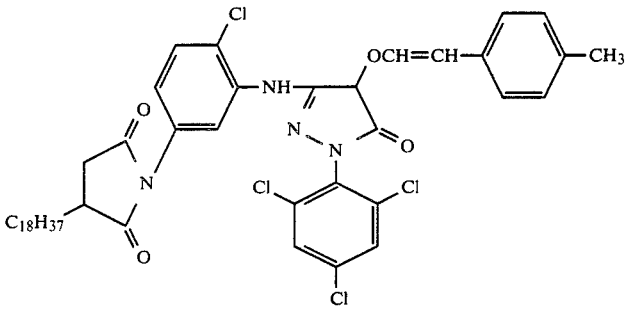
(M-43)
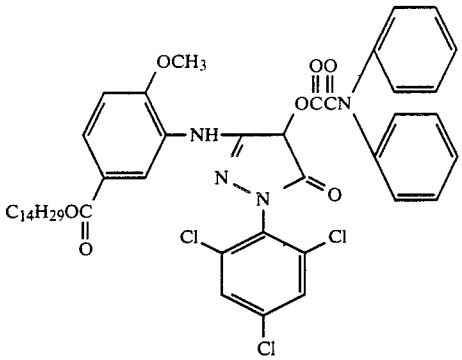
(M-44)
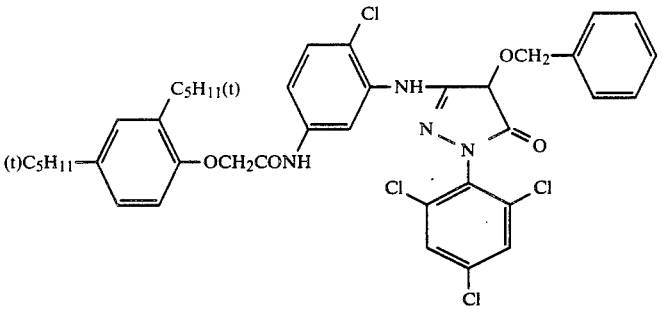
(M-45)
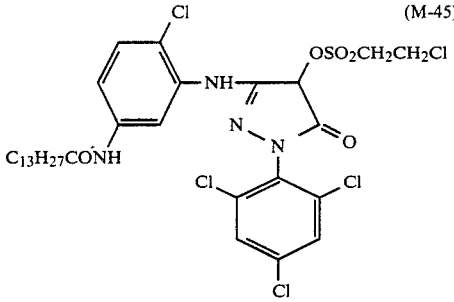
(M-46)
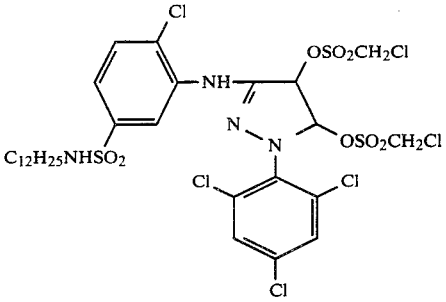
(M-47)
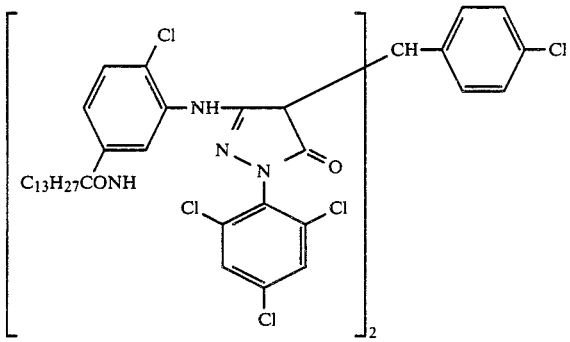
(M-48)
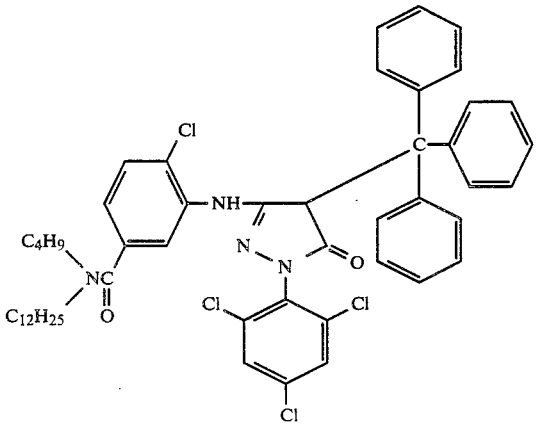

-continued
(M-49)
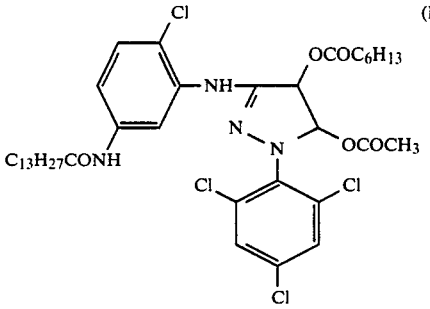
(M-50)
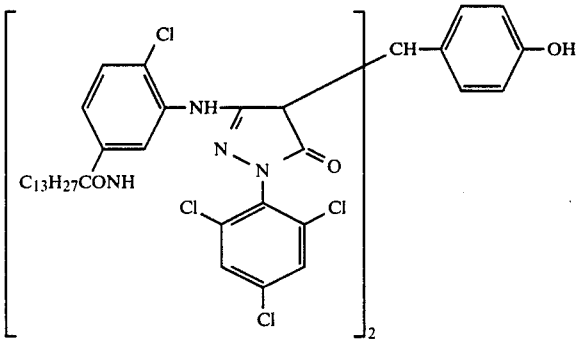
(M-51)
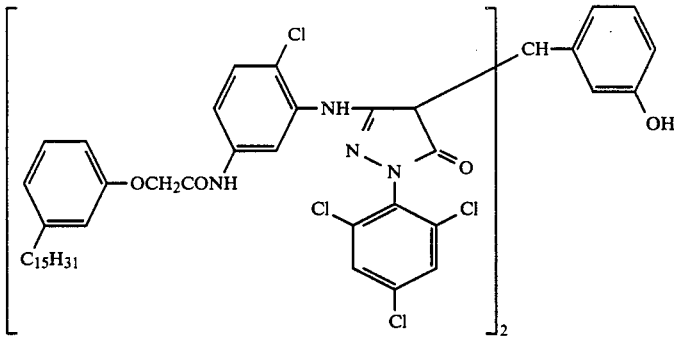
(M-52)
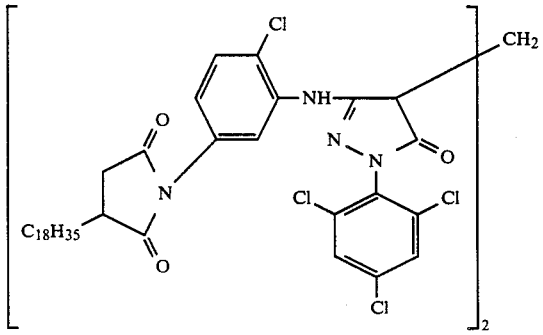
(M-53)
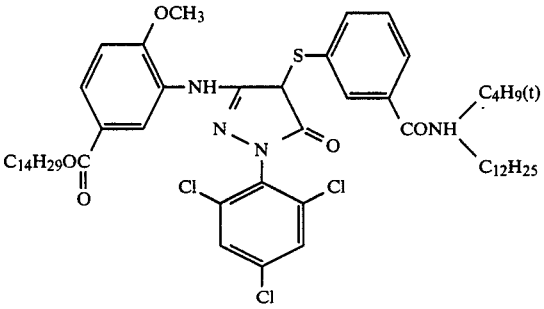
(M-54)
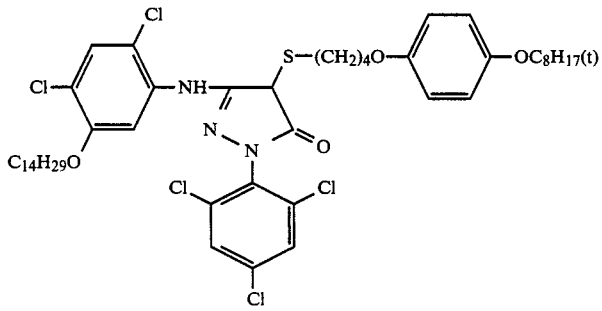
(M-55)
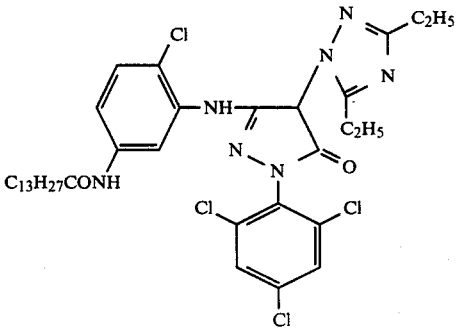

-continued
(M-56)
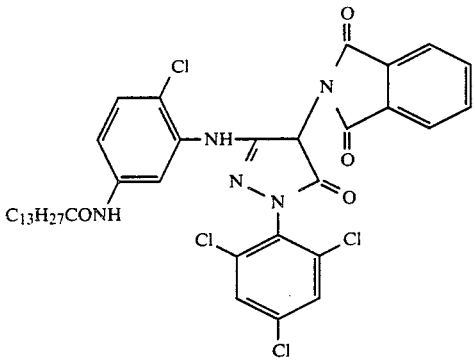
(M-57)
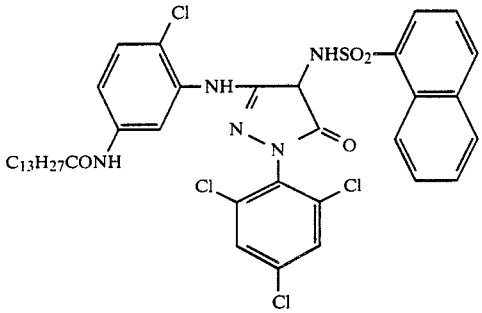
(M-58)
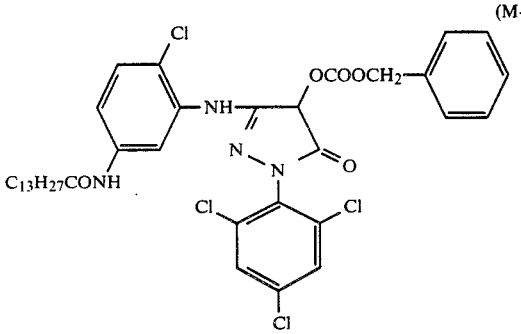
(M-59)
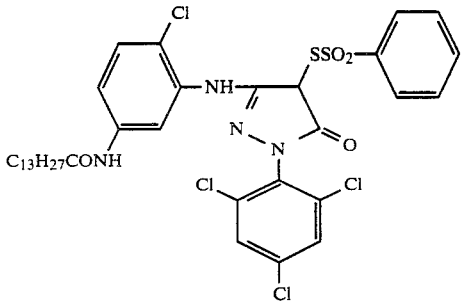
(M-60)
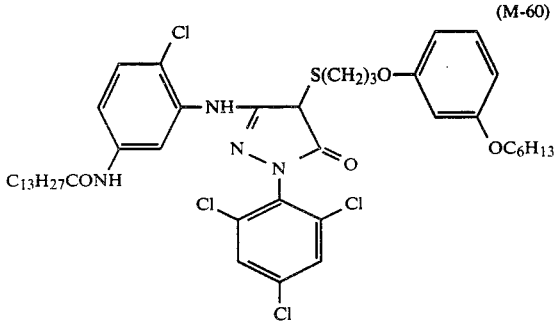
(M-61)
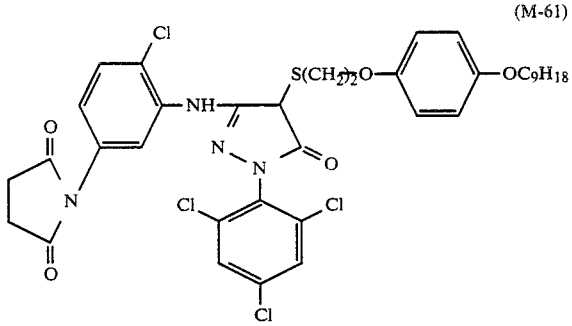
(M-62)
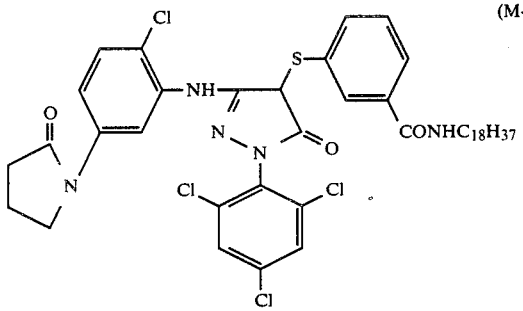
(M-63)
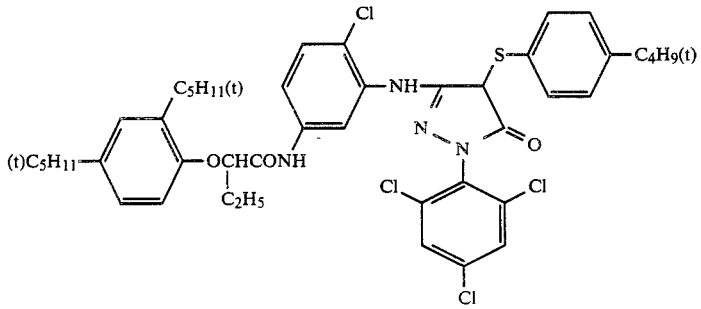

-continued
(M-64)
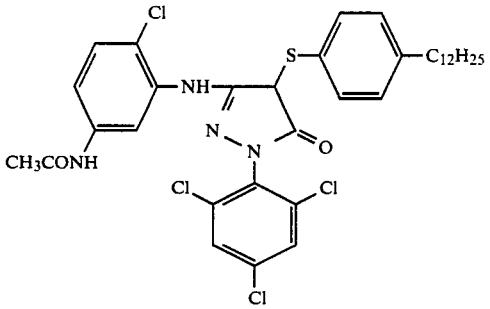
(M-65)
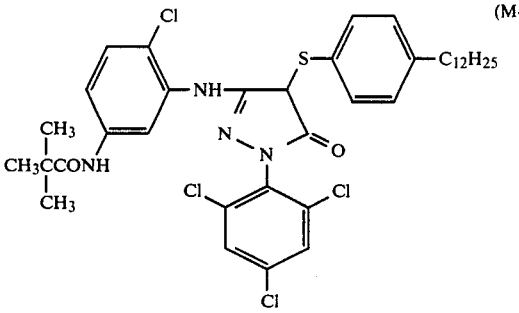
(M-66)
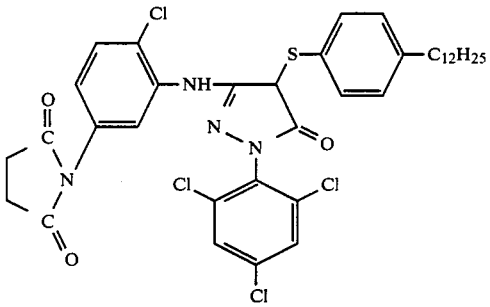
(M-67)
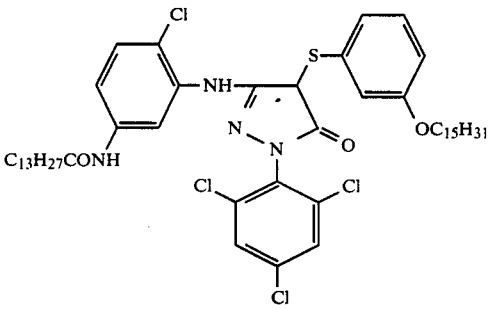
(M-68)
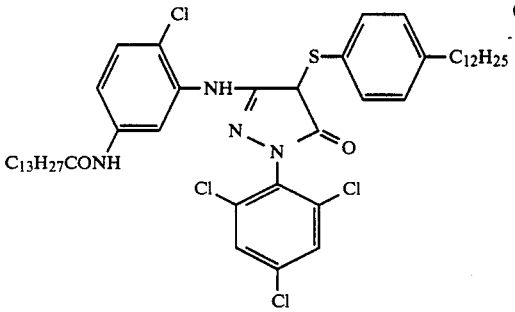
(M-69)
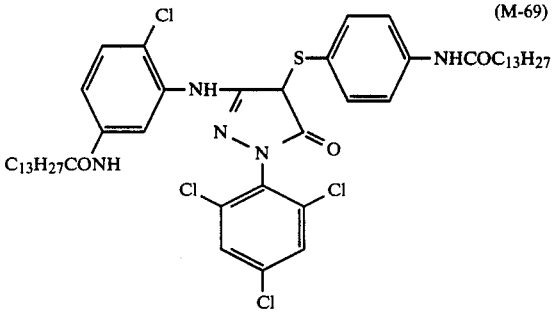
(M-70)
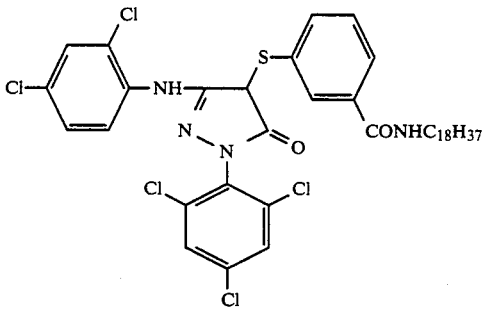
(M-71)
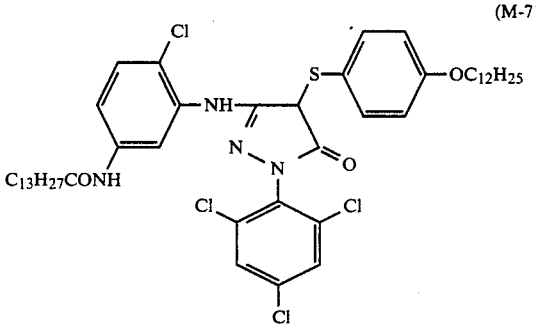
(M-72)
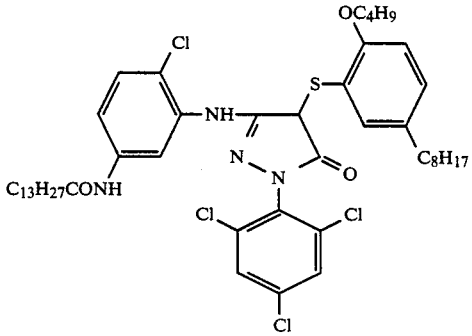
(M-73)
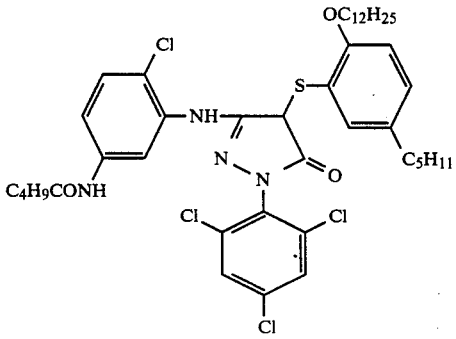

-continued (M-74)

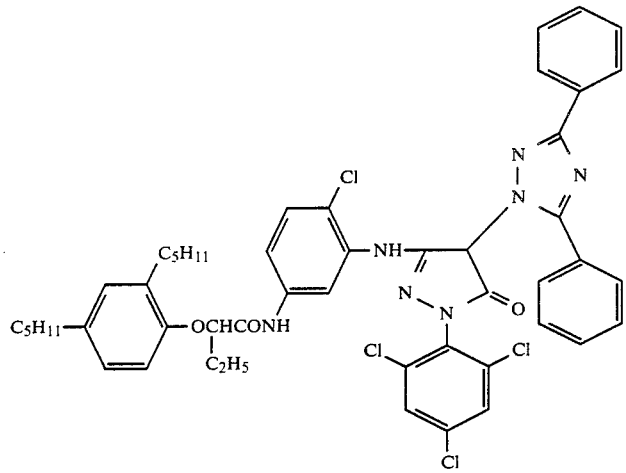

(M-75)

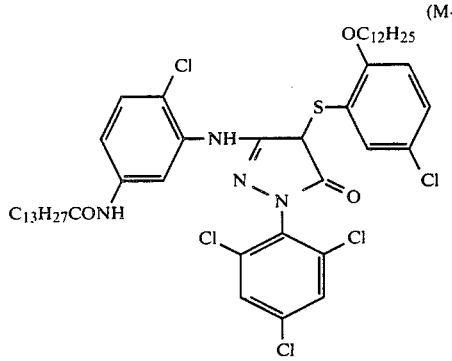

Suitable cyan coupler or couplers which can be used in the present invention are one or more compounds selected from those represented by the following general formula (III):

(III)

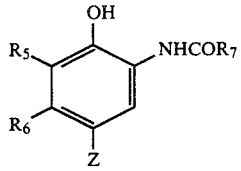

wherein $R_5$ and $R_6$, which may be the same or different, each represents a hydrogen atom, a halogen atom, an optionally substituted alkyl group, an optionally substituted aryl group, an amino group, a carbamoyl group or an acylamino group, $R_7$ represents an optionally substituted alkyl group, an optionally substituted aryl group, a substituted arylamino group or a substituted alkylamino group, and Z represents a coupling-off group.

Suitable substituents for the groups represented by $R_5$, $R_6$ and $R_7$ may be those which are well known with respect to cyan couplers, such as an alkyl group, an aryl group (e.g., a phenyl group, a naphthyl group, etc.), an alkyloxy group (e.g., a methoxy group, a myristyloxy group, a methoxyethoxy group, etc.), an aryloxy group (e.g., a phenyloxy group, a 2,4-di-tert-amylphenoxy group, a 3-tert-butyl-4-hydroxyphenyloxy group, a naphthyloxy group, etc.), a carboxy group, an alkylcarbonyl group (e.g., an acetyl group, a tetradecanoyl group, etc.), an arylcarbonyl group (e.g., a benzoyl group, etc.), an alkoxycarbonyl group (e.g., a methoxycarbonyl group, a benzyloxycarbonyl group, etc.), an aryloxycarbonyl group (e.g., a phenyloxycarbonyl group, a p-tolyloxycarbonyl group, etc.), an acyloxy group (e.g., an acetyloxy group, a benzoyloxy group, a phenylaminocarbonyloxy group, etc.), a sulfamoyl group (e.g., an N-ethylsulfamoyl group, an N-octadecylsulfamoyl group, etc.), a carbamoyl group (e.g., an N-ethylcarbamoyl group, an N-methyldodecylcarbamoyl group, etc.), a sulfonamido group (e.g., a methanesulfonamido group, a benzenesulfonamido group, an ethylaminosulfonamido group, etc.), an acylamino group (e.g., an acetylamino group, a benzamido group, an ethoxycarbonylamino group, a phenylaminocarbonylamino group, etc.), a diacylamino group (e.g., a succinimido group, a hydantoinyl group, etc.), a sulfonyl group (e.g., a methanesulfonyl group, etc.), a hydroxy group, a cyano group, a nitro group, a halogen atom, etc.

The coupling-off group represented by Z may be a hydrogen atom but, preferably, it represents a group forming a 2-equivalent cyan coupler, such as a halogen atom, a sulfo group, an acyloxy group, an alkoxy group, an aryloxy group, a heterocyclic oxy group, an alkylthio group, an arylthio group or a heterocyclic thio group. These groups may be substituted with, for example, an aryl group (e.g., a phenyl group), a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), an alkylsulfonamido group (e.g., a methanesulfonamido group, etc.), an alkylsulfamoyl group (e.g., a methylsulfamoyl group, etc.), a halogen atom (e.g., a fluorine atom, a chlorine atom, a bromine atom, etc.), a carboxy group, an alkylcarbamoyl group (e.g., a methylcarbamoyl group, etc.), an alkoxycarbonyl group (e.g., a methoxycarbonyl group, etc.), an alkylsulfonyl group (e.g., a methylsulfonyl group, etc.), an alkylthio group (e.g., a $\beta$-carboxyethylthio group, etc.), etc. Where two or more such substituents are present, they may be the same or different.

Specific examples of cyan couplers are shown below:

(C-1)

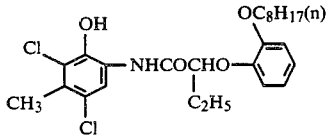

(C-2)

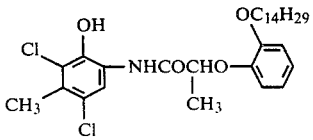

-continued
(C-3)
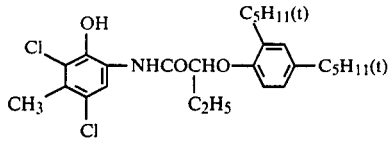
(C-4)
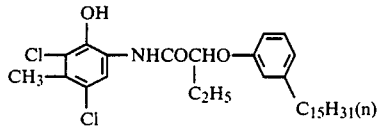
(C-5)
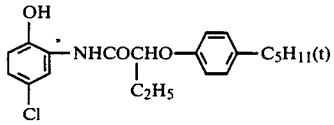
(C-6)
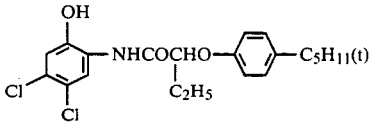
(C-7)
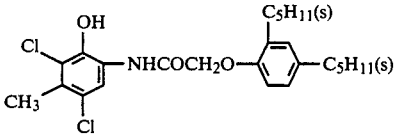
(C-8)
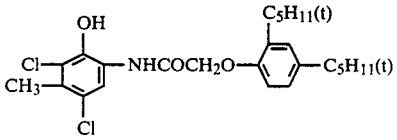
(C-9)
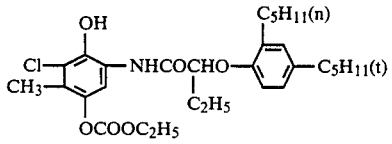
(C-10)
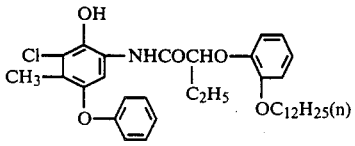
(C-11)
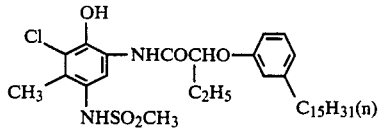
(C-12)
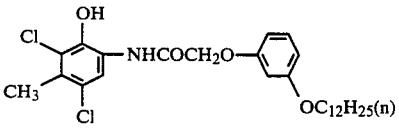
(C-13)
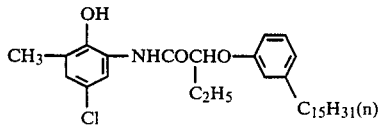
-continued
(C-14)
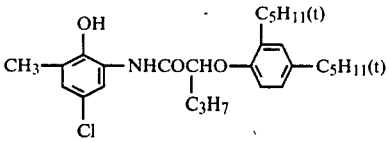
(C-15)
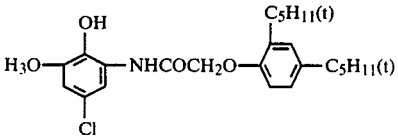
(C-16)
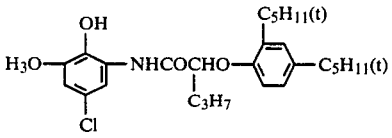
(C-17)
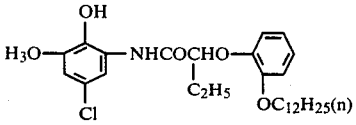
(C-18)
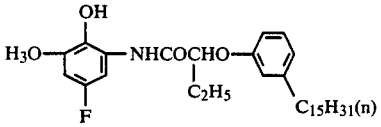
(C-19)
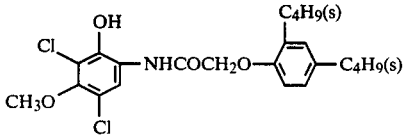
(C-20)
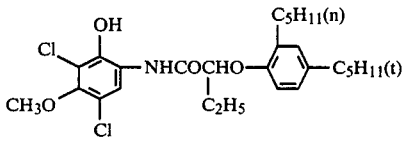
(C-21)
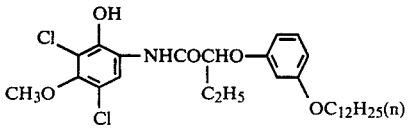
(C-22)
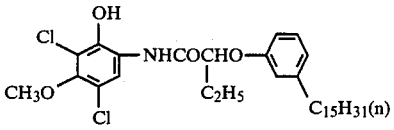
(C-23)
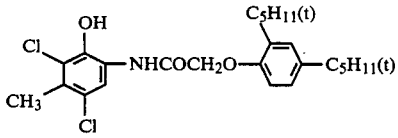
(C-24)
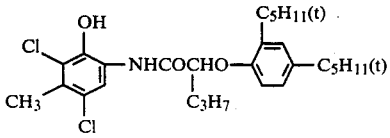

-continued
(C-25)
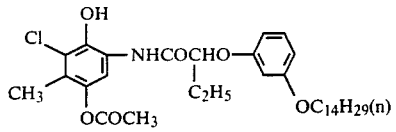
(C-26)
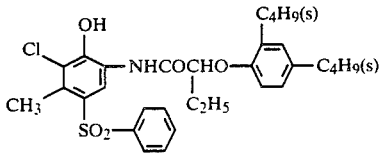
(C-27)
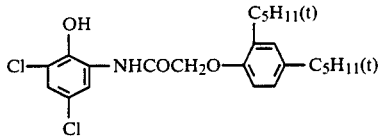
(C-28)
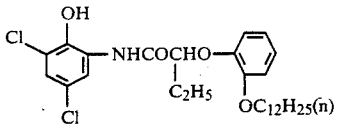
(C-29)
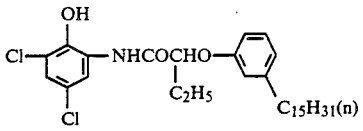
(C-30)
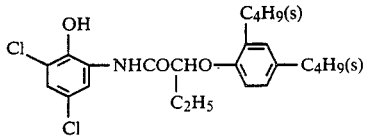
(C-31)
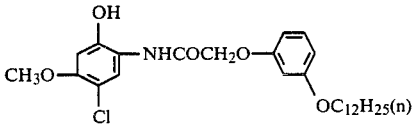
(C-32)
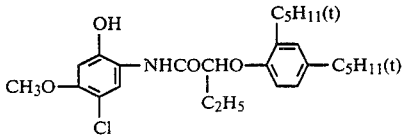
(C-33)
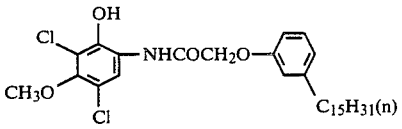
(C-34)
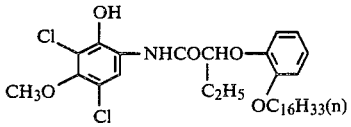
(C-35)
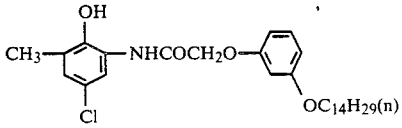
-continued
(C-36)
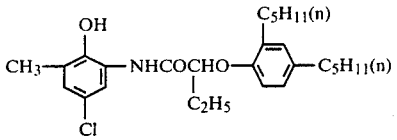
(C-37)
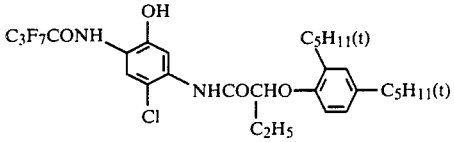
(C-38)
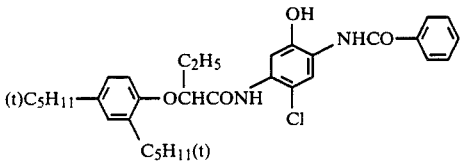
(C-39)
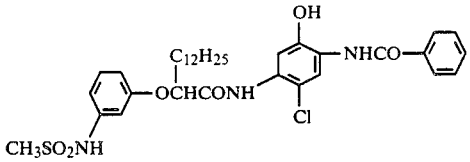
(C-40)
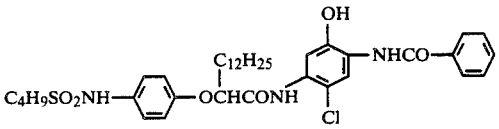
(C-41)
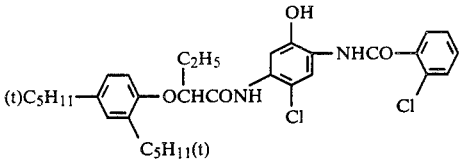
(C-42)
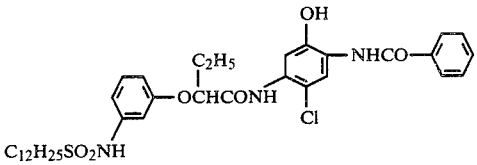
(C-43)
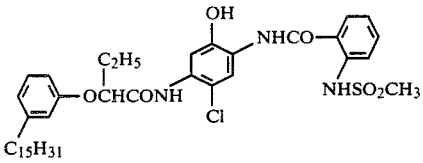
(C-44)
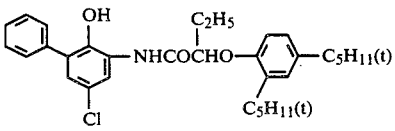
(C-45)
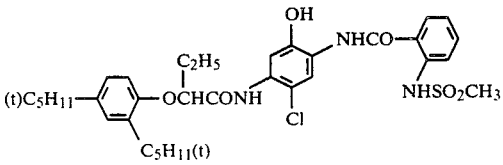

-continued

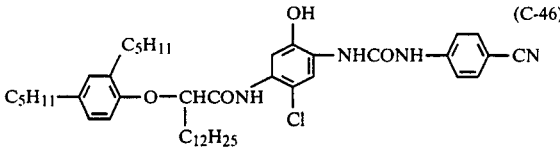

(C-46)

The yellow, magenta and cyan couplers of the present invention can be introduced into a blue-sensitive silver halide emulsion layer, a green-sensitive silver halide emulsion layer, and a red-sensitive silver halide emulsion layer, respectively, for example, as follows. The couplers are dissolved in a high-boiling organic solvent having a boiling point of about 160° C. or above such as an alkyl phthalate (e.g., dibutyl phthalate, dioctyl phthalate, etc.), a phosphoric ester (e.g., diphenyl phosphate, triphenyl phosphate, tricresyl phosphate, dioctylbutyl phosphate, etc.), a citric ester (e.g., tributyl acetylcitrate, etc.), a benzoic ester (e.g., octyl benzoate, etc.), an alkylamide (e.g., diethyllaurylamide, etc.), a fatty acid ester (e.g., dibutoxyethyl succinate, dioctyl azelate, etc.), a phenol compound (e.g., 2,4-di(t)amylphenol, etc.) or the like, or in a low-boiling organic solvent having a boiling point of about 30° to 150° C. such as a lower alkyl acetate (e.g., ethyl acetate, butyl acetate, etc.), ethyl propionate, sec-butyl alcohol, methyl isobutyl ketone, $\beta$-ethoxyethyl acetate, methyl cellosolve acetate, etc., then dispersed in a hydrophilic colloid and mixed with a silver halide emulsion. The high-boiling organic solvent and the low-boiling organic solvent may be used in combination, if desired.

In order to attain the objects of the present invention, the weight ratio of the high-boiling organic solvent to the yellow coupler of the present invention must be adjusted to 1.0:1 or less, preferably 0.1:1 to 0.8:1.

The amount of high-boiling organic solvent to be used for the magenta coupler or the cyan coupler is determined by the different color image stability to light, i.e., from the point of solubility or developability. Usually, the high-boiling organic solvent is used in an amount of about 10% to 300% based on the weight of the magenta coupler or cyan coupler of the present invention.

The amount of a silver halide emulsion to be coated in the color photographic light-sensitive material of the present invention may be freely selected depending upon the end-use of the material. Preferably, however, the blue-sensitive silver halide emulsion layer is coated in a silver amount of 200 mg/m$^2$ to 500 mg/m$^2$, the green-sensitive silver halide emulsion layer in a silver amount of 100 mg/m$^2$ to 300 mg/m$^2$, and the red-sensitive silver halide emulsion layer in a silver amount of 150 to 400 mg/m$^2$. As to the amounts of couplers to be coated, the yellow coupler is preferably coated in an amount of $5\times10^{-4}$ mol/m$^2$ to $12\times10^{-4}$ mol/m$_2$, the magenta coupler in an amount of $2\times10^{-4}$ mol/m$^2$ to $6\times10^{-4}$ mol/m$^2$, and the cyan coupler in an amount of $5\times10^{-4}$ mol/m$^2$ to $12\times10^{-4}$ mol/m$^2$.

In the present invention, an ultraviolet light absorbing layer containing at least one ultraviolet light absorbent represented by the following general formula (IV) is provided on the red-sensitive silver halide emulsion layer:

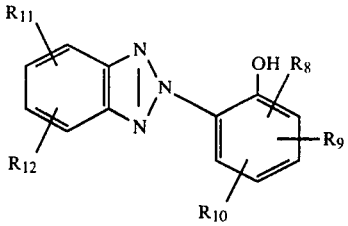

(IV)

wherein $R_8$, $R_9$, $R_{10}$, $R_{11}$ and $R_{12}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or dialkylamino group, an acylamino group, or a 5- or 6-membered heteyocylic group containing at least one of oxygen and nitrogen, or $R_{11}$ and $R_{12}$ may combine and form a 5- or 6-membered aromatic ring composed of carbon atoms. These groups can be substituted.

Such substituents can be arbitrarily selected from, for example, those illustrated above with respect to the phenyl group described for the foregoing general formulae (I), (II) and (III).

The ultraviolet light absorbent to be used in the present invention can be selected from known ultraviolet light absorbents described in, for example, Japanese Patent Publication No. 29620/69, Japanese Patent Application (OPI) Nos. 151149/75 and 95233/79, U.S. Pat. No. 3,766,205, EP 0057160, *Research Disclosure,* 22519 (1983, No. 225), etc.

Typical examples of ultraviolet light absorbents which can be used in the present invention are illustrated below, which, however, are not to be construed as limiting the present invention in any way.

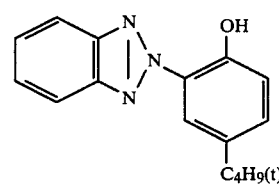

(UV-1)

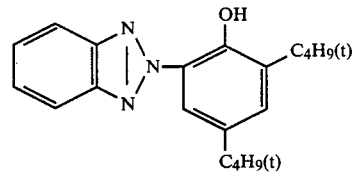

(UV-2)

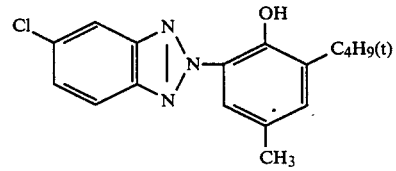

(UV-3)

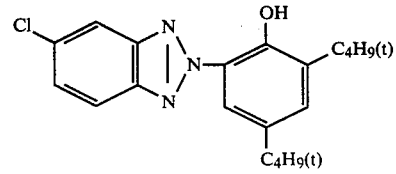

(UV-4)

-continued
(UV-5)
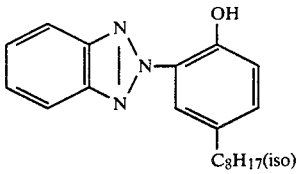
(UV-6)
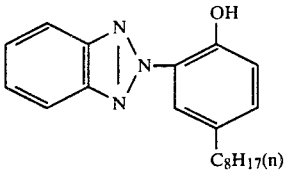
(UV-7)
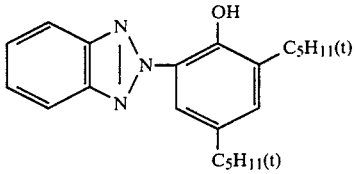
(UV-8)
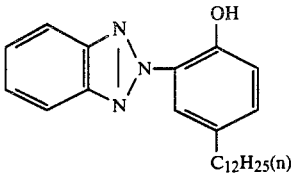
(UV-9)
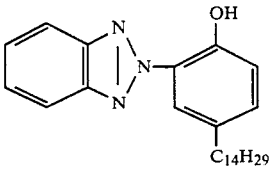
(UV-10)
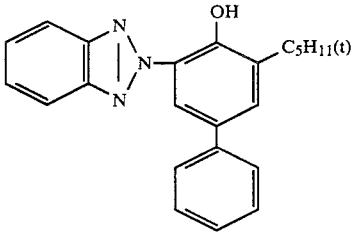
(UV-11)
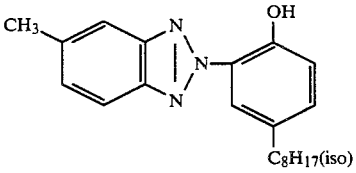
(UV-12)
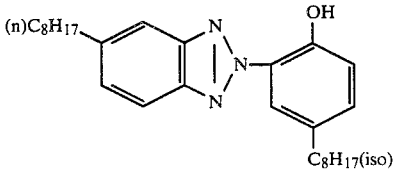
-continued
(UV-13)
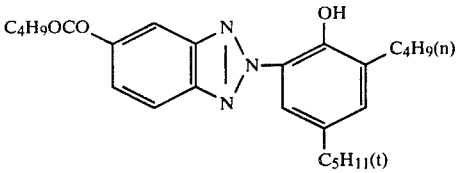
(UV-14)
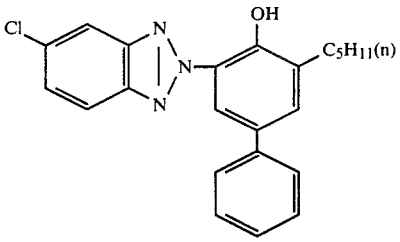
(UV-15)
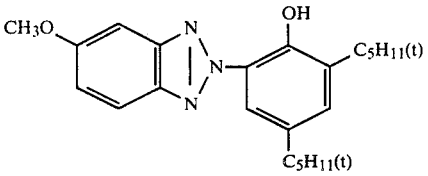
(UV-16)
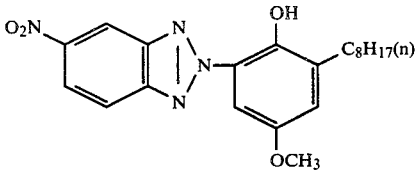
(UV-17)
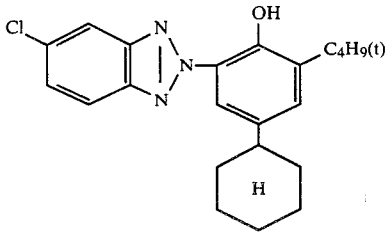
(UV-18)
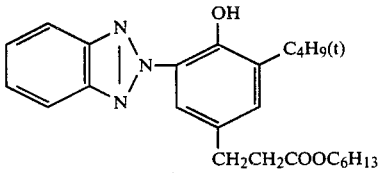
(UV-19)
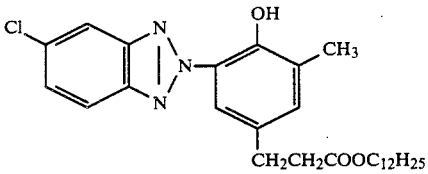
(UV-20)
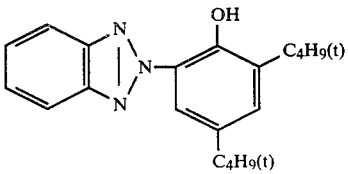

-continued (UV-21)

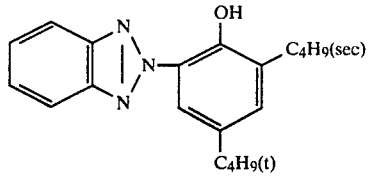

(UV-22)

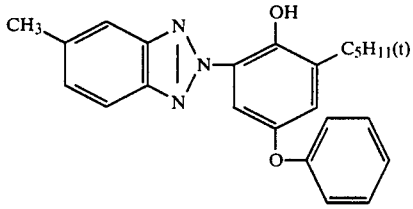

(UV-23)

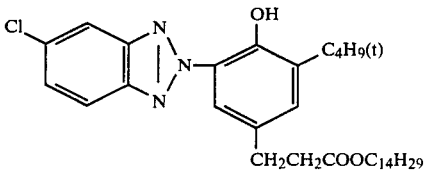

(UV-24)

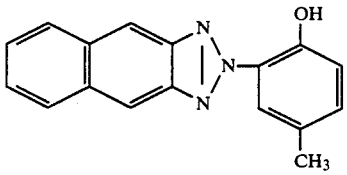

(UV-25)

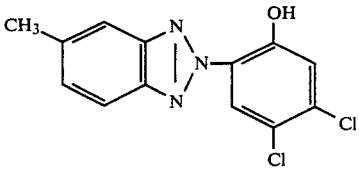

(UV-26)

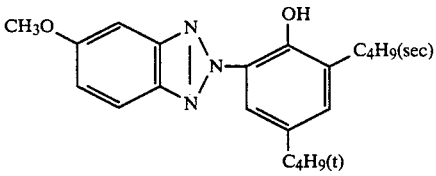

(UV-27)

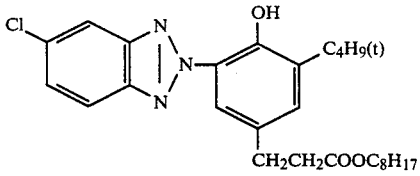

(UV-28)

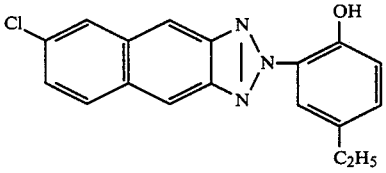

(UV-29)

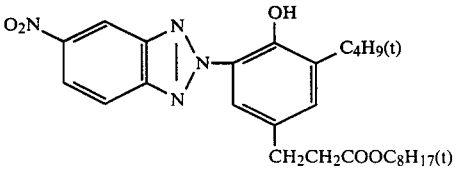

-continued (UV-30)

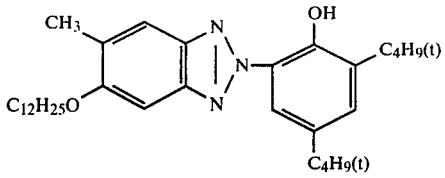

The above-described ultraviolet light absorbent is dissolved in a high-boiling organic solvent and/or a low-boiling organic solvent, and dispersed in a hydrophilic colloid in a manner similar to that used for the couplers. There are no limits on the amounts of the high-boiling organic solvent and the ultraviolet light absorbent which can be used but, usually, the high-boiling organic solvent is employed in an amount of about 10% to 300% based on the weight of the ultraviolet light absorbent.

The ultraviolet light absorbent may be coated in an amount sufficient to stabilize the cyan dye image to light. However, if too much is employed, yellowing of unexposed portions (white portions) of a color photographic light-sensitive material can occur, and hence the coated amount is usually between $1\times10^{-4}$ mol/m$^2$ and $2\times10^{-3}$ mol/m$^2$, particularly between $5\times10^{-4}$ mol/m$^2$ and $1.5\times10^{-3}$ mol/m$^2$.

The silver halides used in the respective layers of the present invention may be any of silver chloride, silver chlorobromide, silver iodobromide, and silver chloroiodobromide. Different kinds of emulsions may be used in combination, and each emulsion layer may be a different kind of emulsion.

The blue-sensitive, green-sensitive and redsensitive emulsions are each spectrally sensitized with a methine dye or the like to possess the appropriate color sensitivity. Dyes which can be used include cyanine dyes, merocyanine dyes, composite cyanine dyes, composite merocyanine dyes, holopolar cyanine dyes, hemicyanine dyes, styryl dyes, and hemioxonol dyes. Particularly useful dyes are cyanine dyes, merocyanine dyes, and composite merocyanine dyes. In these dyes, nuclei ordinarily used as basic heterocyclic nuclei in cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring; and those in which these nuclei are fused with an aromatic hydrocarbon ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can be used. These nuclei may contain substituents on the nuclei carbon atoms.

With merocyanine dyes or composite merocyanine dyes, 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., may be used as ketomethylene structure-containing nuclei.

These sensitizing dyes may be used alone or in combination. Combinations of sensitizing dyes are often employed particularly for the purpose of supersensitization. Typical examples thereof are described in U.S. Pat. No. 2,668,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, Japanese Patent Publication Nos. 4936/68, 12375/78, and Japanese Patent Application (OPI) Nos. 110618/77 and 109925/77.

A dye which itself does not provide a spectrally sensitizing effect or a substance which substantially does not absorb visible light and which exhibits a supersensitizing effect may be used with the sensitizing dye.

In addition to the above-described constituent layers, a subbing layer, interlayer, protective layer, etc., can be present in the color photographic light-sensitive material of the present invention. If desired, a second ultraviolet light absorbing layer may be provided between the red-sensitive silver halide emulsion layer and the green-sensitive silver halide emulsion layer. The above-described ultraviolet light absorbents are preferably used in this ultraviolet light absorbing layer, though other known ultraviolet light absorbents may be used, if desired.

A suitable binder or protective colloid for the photographic emulsion is advantageously gelatin. However, other hydrophilic colloids can be used as well. For example, proteins such as gelatin derivatives, graft polymers between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, partially acetallized polyvinyl alcohol, poly-N-vinyl pyrrolidone, polyacrylic acid, polymethacrylic acid, polyacrylamide, polyvinyl imidazole, polyvinyl pyrazole, etc.) can be used.

Acid-processed gelatin or enzyme-processed gelatin as described in *Bull. Soc. Sci. Phot. Japan,* No. 16, p. 30 (1966) may be used as the gelatin as well as lime-processed gelatin, and a gelatin hydrolyzate or an enzyme-decomposed product can be used.

The photographic emulsion layers and other hydrophilic colloid layers in the light-sensitive material of the present invention may contain fluorescent brightening agents such as stilbenes, triazines, oxazoles, coumarins, etc. These agents may be watersoluble or water-insoluble, with the latter being used in the form of a dispersion. Specific examples of fluorescent brightening agents are described in U.S. Pat. Nos. 2,632,701, 3,269,840, 3,359,102, British Pat. Nos. 852,075, 1,319,763, *Research Disclosure,* Vol. 176, 17643 (1978, Dec.), p. 24, left column, lines 9–36, (description on the brighteners), and the like.

Where dyes or ultraviolet light absorbents are incorporated in the hydrophilic colloidal layers of the light-sensitive material of the present invention, they may be mordanted with a cationic polymer, etc. For example, the polymers described in British Pat. No. 685,475, U.S. Pat. Nos. 2,675,316, 2,839,401, 2,882,156, 3,048,487, 3,184,309, 3,445,231, West German Patent (OLS) No. 1,914,362, Japanese Patent Application (OPI) Nos. 47624/75, 71332/75, etc., can be used.

The light-sensitive material of the present invention may contain hydroquinone derivatives, aminophenol derivatives, gallic acid derivatives, ascorbic acid derivatives, etc., as color fog-preventing agents. Specific examples thereof are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77, Japanese Patent Publication No. 23813/75, etc.

The following known fading-preventing agents can be used in combination in the practice of the present invention. The color image-stabilizing agents used in the present invention may be used alone or as combinations of two or more. Known fading-preventing agents which can be used include, for example, hydroquinone derivatives described in U.S. Pat. Nos. 2,360,290, 2,418,613, 2,675,314, 2,701,197, 2,704,713, 2,728,659, 2,732,300, 2,735,765, 2,710,801, 2,816,028, British Pat. No. 1,363,921, etc., gallic acid derivatives described in U.S. Pat. Nos. 3,457,079, 3,069,262, etc., p-alkoxyphenols described in U.S. Pat. Nos. 2,735,765, 3,698,909, Japanese Patent Publication Nos. 20977/74, 6623/77, etc., p-hydroxyphenol derivatives described in U.S. Pat. Nos. 3,432,300, 3,573,050, 3,574,627, 3,764,337, Japanese Patent Application (OPI) Nos. 35633/77, 147434/77, 152225/77, etc., bisphenols described in U.S. Pat. No. 3,700,455, and the like.

In addition to the above-described ingredients, various photographic additives known in the art, such as stabilizers, antifogging agents, surfactants, couplers other than those of the present invention, filter dyes, irradiation-preventing dyes, developing agents, etc., may be added to the color photographic light-sensitive material of the present invention as the occasion demands.

Further, in some cases, fine silver halide emulsions without substantially any light sensitivity (for example, silver chloride, silver bromide or silver chlorobromide emulsion of a mean grain size of 0.20 $\mu$ or less) may be added to the silver halide emulsion layers or other hydrophilic colloidal layers.

The present invention is described below in greater detail by reference to the following non-limiting example of the present invention. Unless otherwise indicated, all parts, percents, ratios and the like are by weight.

EXAMPLE

Color photographic light-sensitive materials (Samples A to M) were prepared by coating a first layer (lowermost layer) to a seventh layer (uppermost layer) on a paper, laminated on both sides with polyethylene as shown in Table I below.

A coating solution for the above-described first layer was prepared as follows. That is, 100 g of a yellow coupler shown in Table I below was dissolved in 166.7 ml of dibutyl phthalate and 200 ml of ethyl acetate, and the resulting solution was emulsified and dispersed in 800 g of a 10% gelatin aqueous solution containing 80 ml of a 1% sodium dodecylbenzenesulfonate aqueous solution. Then, this emulsion dispersion was mixed with 1,450 g of a blue-sensitive silver chlorobromide emulsion (Br: 80%) (containing 66.7 g of Ag) to prepare the coating solution. Coating solutions of the other layers were prepared in the same manner. 2,4-Dichloro-6-hydroxy-s-triazine sodium salt was used as a hardener for each layer.

The spectrally sensitizing dyes for the respective emulsion layers which were used are described below.

Blue-Sensitive Emulsion Layer:

3,3'-Di($\gamma$-sulfopropyl)selenacyanine sodium salt ($2\times10^{-4}$ mol/mol silver halide)

Green-Sensitive Emulsion Layer:

3,3'-Di(γ-sulfopropyl)-5,5'-diphenyl-9-ethyloxacarbocyanine sodium salt ($2.5\times10^{-4}$ mol/mol silver halide)

Red-Sensitive Emulsion Layer:

3,3'-Di(γ-sulfopropyl)-9-methyl-thiadicarbocyanine sodium salt ($2.5\times10^{-4}$ mol/mol silver halide).

The following irradiation-preventing dyes for respective emulsion layers were used.

Blue-Sensitive Emulsion Layer: .

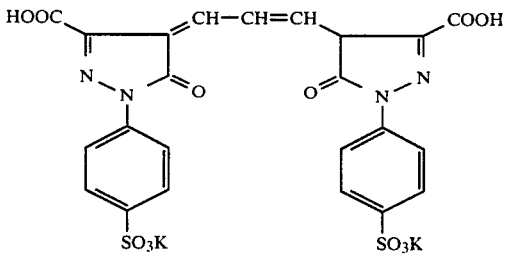

Red-Sensitive Emulsion Layers:

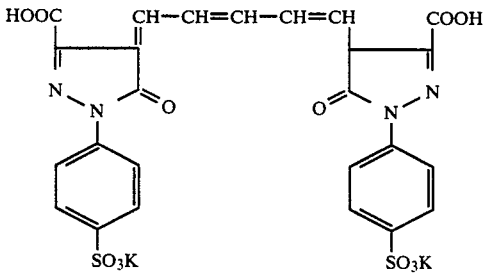

The chemical structures of a, b, c, DBP, and TOP shown in Table I below were as follows.

a:

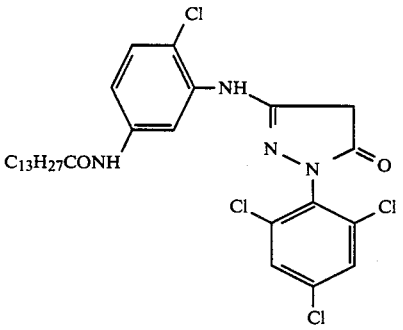

(4-equivalent magenta coupler for comparison)

b:

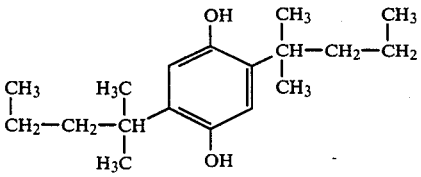

(fading-preventing agent)

c:

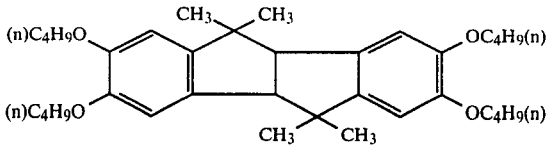

(fading-preventing agent)

DBP

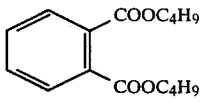

TOP:

$(C_8H_{17}O)_3—P=O$

Each of these samples was exposed (to such a degree that the color density after development became 1.0 or 2.0) using a Fuji Color Head 690 enlarger (made by Fuji Photo Film Co., Ltd.), then developed using the following processing steps. Simultaneously, unexposed samples were subjected to the same development processing.

| Processing Step | Temperature (°C.) | Time |
|---|---|---|
| Development | 33 | 3 min 30 sec |
| Bleach-fixing | 33 | 1 min 30 sec |
| Washing with water | 28–35 | 3 min |

The formulations of the processing solutions used were as follows.

| | |
|---|---|
| Developing Solution | |
| Benzyl Alcohol | 15 ml |
| Diethylene Glycol | 8 ml |
| Disodium Ethylenediaminetetra-acetate | 5 g |
| Sodium Sulfite | 2 g |
| Hydroxylamine Sulfate | 3 g |
| 4-Amino-N—ethyl-N—(β-methane-sulfonamidoethyl)-m-toluidine. $\frac{3}{2}$ sulfate · monohydrate | 5 g |
| Water to make | 1,000 ml |
| | pH: adjusted to 10.20 |
| Bleach-Fixing Solution | |
| Disodium Ethylenediaminetetra-acetate | 2 g |
| Ferric Salt of Ethylenediamine-tetraacetic Acid | 40 g |
| Sodium Sulfite | 5 g |
| Ammonium Thiosulfate | 70 g |
| Water to make | 1,000 ml |
| | pH: adjusted to 6.80 |

Each of the thus processed samples was irradiated for 5 days using a xenon tester (illuminance: 130,000 lux) to conduct discoloring and fading tests. With Samples I to M of the present invention, another fading test of irradiation for 3 days using the same light source was also conducted.

The blue light density, green light density and red light density were measured using a Macbeth densitometer, model RD-514, to obtain the density change of the samples from the initial density of 1.0 or 2.0 and that of the white samples. The results thus obtained are shown in Table II below.

TABLE I

| | | Sample No. | | | | | | | | | | | | |
|---|---|---|---|---|---|---|---|---|---|---|---|---|---|---|
| | | A | B | C | D | E | F | G | H | I | J | K | L | M |
| Seventh Layer (protective layer) | Gelatin Coated Amount | 1,500 mg/m$^2$ | " | " | " | " | " | " | " | " | " | " | " | " |
| Sixth Layer (UV light absorbing layer) | Gelatin Coated Amount | — | 1,500 mg/m$^2$ | " | " | " | " | — | — | 1,500 mg/m$^2$ | " | " | " | " |
| | UV Light Absorbent Kind | — | — | UV-4/ UV-1/ UV-21 | " | " | " | — | — | UV-4/ UV-1/ UV-21 | " | UV-7/ UV-3 | UV-27 | UV-7/ UV-27 |
| | Amount | — | — | 50/ 150/ 300 mg/m$^2$ | " | " | " | — | — | 50/ 150/ 300 mg/m$^2$ | " | 400/ 100 mg/m$^2$ | 450 mg/m$^2$ | 200/ 200 mg/m$^2$ |
| | Solvent for Absorbent Kind | — | — | DBP | " | " | " | — | — | DBP | " | " | — | DBP |
| | Amount | — | — | 200 mg/m$^2$ | " | " | " | — | — | 200 mg/m$^2$ | " | " | — | 100 mg/m$^2$ |
| Fifth Layer (red-sensitive layer) | Amount of AgClBr Emulsion (Br 50%) (as Ag) | 300 mg/m$^2$ | " | " | " | " | " | " | " | " | " | " | " | " |
| | Cyan Coupler Kind | C-3 | " | " | " | " | " | " | " | " | " | C-8/ C-4 | " | " |
| | Amount | 400 mg/m$^2$ | " | " | " | " | " | " | " | " | " | 50/ 350 mg/m$^2$ | " | " |
| | Solvent for Cyan Coupler Kind | DBP | " | " | " | " | " | " | " | " | " | " | " | " |
| | Amount | 240 mg/m$^2$ | " | " | " | " | " | " | " | " | " | " | " | " |
| Fourth Layer (UV light absorbing layer) | Amount of Coated Gelatin | 2,000 mg/m$^2$ | " | " | " | " | " | " | " | " | " | " | " | " |
| | UV Light Absorbent Kind | — | — | — | — | — | — | — | UV-4/ UV-1/ UV-21 | — | UV-4/ UV-1/ UV-21 | " | " | " |
| | Amount | — | — | — | — | — | — | — | 15/ 45/ 90 mg/m$^2$ | — | 15/ 45/ 90 mg/m$^2$ | " | " | " |
| | Solvent for UV Light Absorbent Kind | — | — | — | — | — | — | — | DBP | — | DBP | " | " | " |
| | Amount | — | — | — | — | — | — | — | 60 mg/m$^2$ | — | 60 mg/m$^2$ | " | " | " |
| Third Layer (green-sensitive layer) | Amount of AgClBr Emulsion (Br 70%) (as Ag) | 450 mg/m$^2$ | " | " | " | " | " | 200 mg/m$^2$ | " | " | " | " | " | " |
| | Magenta Coupler Kind | a | " | " | " | " | " | M-72 | " | " | " | M-75 | M-55 | M-11 |

TABLE I-continued

| | | Sample No. | | | | | | | | | | | | |
|---|---|---|---|---|---|---|---|---|---|---|---|---|---|---|
| | | A | B | C | D | E | F | G | H | I | J | K | L | M |
| | Amount | 350 mg/m² | " | " | " | " | " | 300 mg/m² | " | " | " | " | 250 mg/m² | 230 mg/m² |
| | Solvent for Magenta Coupler | | | | | | | | | | | | | |
| | Kind | TOP | " | " | " | " | " | " | " | " | " | " | " | " |
| | Coated Amount | 440 mg/m² | " | " | " | " | " | 400 mg/m² | " | " | " | " | 300 mg/m² | " |
| | Fading-Preventing Agent | | | | | | | | | | | | | |
| | Kind | — | — | — | — | — | b/c | — | — | — | b/c | — | — | b/c |
| | Coated Amount | — | — | — | — | — | 50/100 mg/m² | — | — | — | 50/100 mg/m² | — | — | 50/100 mg/m² |
| Second Layer (color mixing-preventing agent) | Amount of Coated Gelatin | 1,500 mg/m² | " | " | " | " | " | " | " | " | " | " | " | " |
| First Layer (blue-sensitive layer) | AgClBr Emulsion (Br 80%) (as Ag) | 400 mg/m² | " | " | " | " | " | " | " | " | " | " | " | " |
| | Yellow Coupler | | | | | | | | | | | | | |
| | Kind | Y-49 | " | " | " | " | " | " | " | " | " | Y-48 | Y-38 | Y-52 |
| | Coated Amount | 600 mg/m² | " | " | " | " | " | " | " | " | " | 650 mg/m² | 600 mg/m² | 700 mg/m² |
| | Solvent for Yellow Coupler | | | | | | | | | | | | | |
| | Kind | DBP | " | " | " | " | " | " | " | " | " | TOP | " | " |
| | Coated Amount | 1,000 mg/m² | " | " | 550 mg/m² | 250 mg/m² | " | " | 1,000 mg/m² | 100 mg/m² | 100 mg/m² | 100 mg/m² | 100 mg/m² | 180 mg/m² |
| Support | | Paper double-laminated with polyethylene | | | | | | | | | | | | |
| | | * | * | * | * | * | * | * | * | ** | ** | ** | ** | ** |

Notes
*: Comparative sample;
**: Sample of the present invention
(Note): "/" stands for the same meaning as given in the left column.

TABLE II

| Sample No. | Note | Gray.Density 1.0 | | | Gray.Density 2.0 | | | Unexposed Portion; White Background | | |
|---|---|---|---|---|---|---|---|---|---|---|
| | | $D_o^B = 1.0$ | $D_o^G = 1.0$ | $D_o^R = 1.0$ | $D_o^B = 2.0$ | $D_o^G = 2.0$ | $D_o^R = 2.0$ | $\Delta D^B$ | $\Delta D^G$ | $\Delta D^R$ |
| A | * | 0.53 | 0.36 | 0.74 | 1.10 | 0.95 | 1.79 | 0.51 | 0.20 | 0.03 |
| B | * | 0.55 | 0.35 | 0.78 | 1.03 | 0.89 | 1.75 | 0.49 | 0.18 | 0.05 |
| C | * | 0.61 | 0.56 | 0.94 | 1.12 | 1.31 | 1.91 | 0.11 | 0.03 | 0.02 |
| D | * | 0.82 | 0.55 | 0.93 | 1.56 | 1.29 | 1.93 | 0.12 | 0.03 | 0.02 |
| E | * | 0.91 | 0.56 | 0.93 | 1.89 | 1.27 | 1.90 | 0.11 | 0.02 | 0.01 |
| F | * | 0.91 | 0.78 | 0.91 | 1.90 | 1.64 | 1.92 | 0.10 | 0.01 | 0.01 |
| G | * | 0.83 | 0.64 | 0.75 | 1.78 | 1.45 | 1.76 | 0.55 | 0.21 | 0.03 |
| H | * | 0.62 | 0.88 | 0.78 | 1.13 | 1.92 | 1.75 | 0.10 | 0.02 | 0.05 |
| I | ** | 0.91 | 0.89 | 0.91 | 1.92 | 1.94 | 1.93 | 0.09 | 0.02 | 0.02 |
| | | (0.95) | (0.93) | (0.95) | (1.96) | (1.98) | (1.97) | (0.05) | (0.02) | (0.02) |
| J | ** | 0.93 | 0.94 | 0.95 | 1.93 | 1.95 | 1.95 | 0.05 | 0.01 | 0.01 |
| K | ** | 0.95 | 0.92 | 0.95 | 1.93 | 1.91 | 1.94 | 0.08 | 0.02 | 0.02 |
| L | ** | 0.92 | 0.90 | 0.94 | 1.92 | 1.90 | 1.95 | 0.08 | 0.01 | 0.02 |
| M | ** | 0.94 | 0.93 | 0.94 | 1.92 | 1.90 | 1.92 | 0.06 | 0.01 | 0.02 |

*: Comparative sample;
**: Sample of the present invention ($D_o^B$, $D_o^G$, and $D_o^R$, respectively, represent the initial yellow, magenta and cyan densities, and $\Delta D^B$, $\Delta D^G$ and $\Delta D^R$, respectively, represent increases of yellow, magenta and cyan in white background. The values shown in parentheses with Sample I show the results obtained by conducting the 3-day light-fading test.)

Table II clearly shows the following.

Firstly, the stability of the magenta dye images to light is greatly improved by changing the coupler to that of the present invention (as can be seen by comparing Sample H with Samples A to F). However, independent improvement by this change results in color unbalance (Sample H).

The stability of the yellow dye images to light is greatly varied depending upon the weight ratio of the high-boiling organic solvent to the pivaloylacetanilide type yellow coupler and, when the ratio becomes not more than 1.0:1, particularly not more than 0.8:1, it is greatly improved (as can be seen by comparing Samples C to G with Samples A to B). However, independent improvement by this technique fails to maintain a definite color balance.

In addition, the stability of cyan dye images to light is greatly improved by providing an ultraviolet light absorbing layer on or above the red-sensitive emulsion layer. However, Samples C to F show unbalanced yellow and magenta dye images in comparison with the cyan dye images.

On the other hand, in Samples I to M of the present invention, the above-described techniques are combined; i.e., the weight ratio of the high-boiling organic solvent to the pivaloylacetanilide type yellow coupler is adjusted to not more than 1.0:1, a magenta coupler specified in the present invention is used, and a layer containing an ultraviolet light absorbent of the present invention is provided on or above the red-sensitive silver halide emulsion layer. Accordingly, the yellow, magenta and cyan dye images have an extremely good stability. Further, as is clear from the experimental results of, for example, Sample I of the present invention, fading by light occurs with difficulty and, in addition, even when a reduction in density occurs, the three yellow, magenta and cyan colors are well balanced during the reduction, thus they are visually extremely advantageous.

Each of yellow, magenta and cyan dye images of Samples I to M of the present invention were extremely stable with time under high-temperature and high-humidity conditions.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon, in sequence:

(1) a blue-sensitive silver halide emulsion layer containing, dispersed in the emulsion using a high-boiling organic solvent, a yellow coupler represented by the following general formula (I):

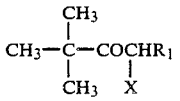

(I)

wherein $R_1$ represents an unsubstituted or substitured N-phenylcarbamoyl group, and X represents a coupling-off group, with the weight ratio of the high-boiling organic solvent for dispersing the coupler to the yellow coupler being 1.0:1 or less;

(2) a green-sensitive silver halide emulsion layer containing a magenta coupler represented by the following general formula (II):

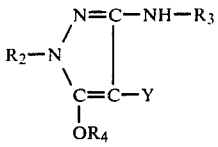

(II)

wherein $R_2$ and $R_3$ each represents an unsubstituted or substituted phenyl group, $R_4$ represents a sulfonyl group, an acyl group or a hydrogen atom, and Y represents a coupling-off group forming a 2-equivalent magenta coupler;

(3) a red-sensitive silver halide emulsion layer containing a cyan coupler represented by the following general formula (III):

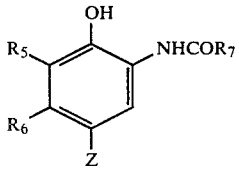

(III)

wherein $R_5$ and $R_6$, which may be the same or different, each represents a hydrogen atom, a halogen atom, an unsubstituted or substituted alkyl group, an unsubstituted or substituted aryl group, an amino group, a carbamoyl group or an acylamino group, $R_7$ represents an unsubstituted or substituted alkyl group, an unsubstituted or substituted aryl group, a substituted arylamino group or a substituted alkylamino group, and Z represents a coupling-off group; and (4) an ultraviolet light absorbing layer containing an ultraviolet light absorbent represented by the following general formula (IV):

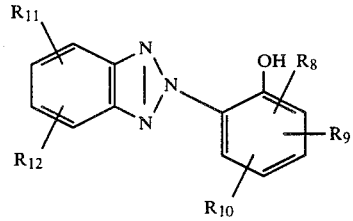

(IV)

wherein $R_8$, $R_9$, $R_{10}$, $R_{11}$ and $R_{12}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or dialkylamino group, an acylamino group, or a 5- or 6-membered heterocyclic group containing at least one oxygen or nitrogen atom, or $R_{11}$ and $R_{12}$ may combine and form a 5- or 6-membered aromatic ring, where these groups may be further substituted.

2. The color photographic light-sensitive material of claim 1, wherein the ratio of the high-boiling organic solvent to the yellow coupler is in a range of from 0.1 to 0.8 weight parts of organic solvent to 1 weight part of yellow coupler.

3. The color photographic light-sensitive material of claim 1, wherein said N-phenylcarbamoyl group is substituted with one or more of an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxy group, a sulfo group, a nitro group, a cyano group or a thiocyano group.

4. The color photographic light-sensitive material of claim 1, wherein X is a coupling-off group forming a 2-equivalent yellow coupler.

5. The color photographic light-sensitive material of claim 4, wherein X is a group represented by the following general formula (X), (XI), (XII) or (XIII):

(X)

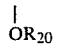

wherein $R_{20}$ represents an unsubstituted or substituted aryl or heterocyclic group;

(XI)

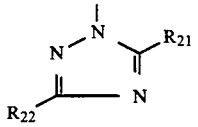

(XII)

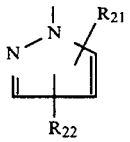

wherein $R_{21}$ and $R_{22}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group or an unsubstituted or substituted phenyl or heterocyclic group;

(XIII)

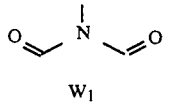

wherein $W_1$ represents the non-metallic atoms necessary for forming a 4-, 5- or 6-membered ring together with

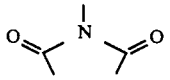

in the formula.

6. The color photographic light-sensitive material of claim 5, wherein said coupling-off group represented by the general formula (XIII) is represented by the formulas (XIV) to (XVI)

(XIV)

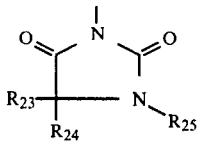

(XV)

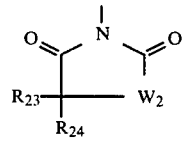

(XVI)

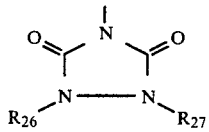

wherein $R_{23}$ and $R_{24}$ each represents a hydrogen atom, an alkyl group, an aryl group, an alkoxy group, an aryloxy group or a hydroxy group, $R_{25}$, $R_{26}$ and $R_{27}$ each represents a hydrogen atom, an alkyl group, an aryl group, an aralkyl group or an acyl group, and $W_2$ represents an oxygen atom or a sulfur atom.

7. The color photographic light-sensitive material of claim 1, wherein said phenyl group for $R_2$ and $R_3$ is an unsubstituted phenyl group or a phenyl group substituted with one or more of an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group or a halogen atom.

8. The color photographic light-sensitive material of claim 1, wherein Y is bonded to the coupling position through an oxygen atom, a nitrogen atom or a sulfur atom and an alkyl group, an aryl group, an alkylsulfonyl group, an arylsulfonyl group, an alkylcarbonyl group, an arylcarbonyl group or a heterocyclic group is bonded through said oxygen atom, said nitrogen atom or said sulfur atom to said coupling position, and where Y is bonded to said coupling position through a nitrogen atom, a 5- or 6-membered ring together with said nitrogen atom forms said Y bonded to said coupling position.

9. The color photographic light-sensitive material of claim 1, wherein said sulfonyl group and said acyl group for $R_4$ may be substituted with a lower alkyl group or a lower haloalkyl group.

10. The color photographic light-sensitive material of claim 1, wherein $R_5$, $R_6$ and $R_7$ is substituted with one or more of an alkyl group, an aryl group, an alkyloxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, a sulfonamido group, an acylamino group, a diacylamino group, a sulfonyl group, a hydroxy group, a cyano group, a nitro group and a halogen atom.

11. The color photographic light-sensitive material of claim 1, wherein the coupling-off group represented by Z is a halogen atom, a sulfo group, an acyloxy group, an alkoxy group, an aryloxy group, a heterocyclic oxy group, an alkylthio group, an arylthio group or a heterocyclic thio group, which groups may be substituted with one or more of an aryl group, a nitro group, a hydroxy group, a cyano group, a sulfo group, an alkoxy group, an aryloxy group, an acyloxy group, an acylamino group, an alkylsulfonamido group, an alkylsulfamoyl group, a halogen atom, a carboxy group, an alkylcarbamoyl group, an alkoxycarbamoyl group, an alkylsulfonyl group and an alkylthio group.

12. The color photographic light-sensitive material of claim 1, wherein $R_8$, $R_9$, $R_{10}$, $R_{11}$ and $R_{12}$ is substituted with one or more substituents as described above for the general formulae (I), (II) and (III) of claim 1.

13. The color photographic light-sensitive material of claim 1, wherein the blue-sensitive silver halide emulsion layer, green-sensitive silver halide emulsion layer and red-sensitive silver halide emulsion layer are coated in silver amounts of 200 mg/m$^2$ to 500 mg/m$^2$, 100 mg/m$^2$ to 300 mg/m$^2$ and 150 mg/m$^2$ to 400 mg/m$^2$, respectively.

14. The color photographic light-sensitive material of claim 1, wherein the yellow coupler, magenta coupler and cyan coupler are coated in amounts of $5\times10^{-4}$ mol/m$^2$ to $12\times10^{-4}$ mol/m$^2$, $2\times10^{-4}$ mol/m$^2$ to $6\times10^{-4}$ mol/m$^2$ and $5\times10^{-4}$ mol/m$^2$ to $12\times10^{-4}$ mol/m$^2$, respectively.

15. The color photographic light-sensitive material of claim 1, wherein the ultraviolet light absorbent is coated in an amount of $1\times10^{-4}$ mol/m$^2$ to $2\times10^{-3}$ mol/m$^2$.

16. The color photographic light-sensitive material of claim 1, wherein a second ultraviolet light absorbing layer is provided between the red-sensitive silver halide emulsion layer and the green-sensitive silver halide emulsion layer.

* * * * *